US011913298B2

(12) United States Patent
Al-Mousa

(10) Patent No.: US 11,913,298 B2
(45) Date of Patent: Feb. 27, 2024

(54) DOWNHOLE MILLING SYSTEM

(71) Applicant: Saudi Arabian Oil Company, Dhahran (SA)

(72) Inventor: Ahmed Al-Mousa, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 158 days.

(21) Appl. No.: 17/510,027

(22) Filed: Oct. 25, 2021

(65) Prior Publication Data

US 2023/0125323 A1 Apr. 27, 2023

(51) Int. Cl.
*E21B 29/00* (2006.01)

(52) U.S. Cl.
CPC ..... *E21B 29/002* (2013.01)

(58) Field of Classification Search
CPC ..... E21B 29/00; E21B 29/002; E21B 29/005
See application file for complete search history.

(56) References Cited

U.S. PATENT DOCUMENTS

| | | | |
|---|---|---|---|
| 792,191 | A | 8/1904 | Blameuser |
| 880,404 | A | 2/1908 | Sanford |
| 1,033,655 | A | 7/1912 | Baker |
| 1,258,273 | A | 3/1918 | Titus et al. |
| 1,392,650 | A | 10/1921 | Mcmillian |
| 1,491,066 | A | 4/1924 | Patrick |
| 1,580,352 | A | 4/1926 | Ercole |
| 1,591,264 | A | 7/1926 | Baash |
| 1,621,947 | A | 3/1927 | Moore |
| 1,638,494 | A | 8/1927 | Lewis et al. |
| 1,789,993 | A | 1/1931 | Switzer |
| 1,896,236 | A | 2/1933 | Howard |
| 1,896,482 | A | 2/1933 | Crowell |
| 1,897,297 | A | 2/1933 | Brown |

(Continued)

FOREIGN PATENT DOCUMENTS

| | | |
|---|---|---|
| AU | 636642 | 5/1993 |
| AU | 2007249417 | 11/2007 |

(Continued)

OTHER PUBLICATIONS

Al-Ansari et al., "Thermal Activated Resin to Avoid Pressure Build-Up in Casing-Casing Annulus (CCA)," SA-175425-MS, Society of Petroleum Engineers (SPE), presented at the SPE Offshore Europe Conference and Exhibition, Sep. 8-11, 2015, 11 pages.

(Continued)

*Primary Examiner* — Christopher J Sebesta
(74) *Attorney, Agent, or Firm* — Fish & Richardson P.C.

(57) ABSTRACT

A well tool for milling a tubular includes a well tubing disposed in a wellbore and including a circulation fluid pathway through an interior of the well tubing, a first milling tool coupled to the well tubing at a first longitudinal end of the well tubing, a second milling tool coupled to the well tubing at a location longitudinally uphole from the first milling tool, and a third milling tool coupled to the well tubing at a location longitudinally uphole from the second milling tool. Each of the milling tools include a mill bit and a circulation sub fluidly connected to the circulation fluid pathway. The first milling tool mills a first portion of the tubular, the second milling tool mills a second portion of the tubular, and the third milling tool mills a third portion of the tubular.

25 Claims, 11 Drawing Sheets

(56) References Cited

U.S. PATENT DOCUMENTS 1,949,498 A 3/1934 Frederick et al.
1,979,500 A 11/1934 Sniffin
2,047,774 A 7/1936 Greene
2,121,002 A 6/1938 Baker
2,121,051 A 6/1938 Ragan et al.
2,187,487 A 1/1940 Burt
2,189,697 A 2/1940 Baker
2,222,233 A 11/1940 Mize
2,286,075 A 6/1942 Evans
2,304,793 A 12/1942 Bodine
2,316,402 A 4/1943 Canon
2,327,092 A 8/1943 Botkin
2,377,249 A 5/1945 Lawrence
2,411,260 A 11/1946 Glover et al.
2,481,637 A 9/1949 Yancey
2,546,978 A 4/1951 Collins et al.
2,638,988 A 5/1953 Williams
2,663,370 A 12/1953 Robert et al.
2,672,199 A 3/1954 McKenna
2,701,019 A 2/1955 Steed
2,707,998 A 5/1955 Baker et al.
2,708,973 A 5/1955 Twining
2,728,599 A 12/1955 Moore
2,734,581 A 2/1956 Bonner
2,735,485 A * 2/1956 Metcalf ..... E21B 29/002 30/103
2,745,693 A 5/1956 Mcgill
2,751,010 A 6/1956 Trahan
2,762,438 A 9/1956 Naylor
2,778,428 A 1/1957 Baker et al.
2,806,532 A 9/1957 Baker et al.
2,881,838 A 4/1959 Morse et al.
2,887,162 A 5/1959 Le Bus et al.
2,912,053 A 11/1959 Bruekelman
2,912,273 A 11/1959 Chadderdon et al.
2,915,127 A 12/1959 Abendroth
2,935,020 A 5/1960 Howard et al.
2,947,362 A 8/1960 Smith
2,965,175 A 12/1960 Ransom
2,965,177 A 12/1960 Le Bus et al.
2,965,183 A 12/1960 Le Bus et al.
3,005,506 A 10/1961 Le Bus et al.
3,023,810 A 3/1962 Anderson
3,116,799 A 1/1964 Lemons
3,147,536 A 9/1964 Lamphere
3,187,238 A 6/1965 Wilson et al.
3,191,677 A 6/1965 Kinley
3,225,828 A 12/1965 Wisenbaker et al.
3,308,886 A 3/1967 Evans
3,352,593 A 11/1967 Webb
3,369,603 A 2/1968 Trantham
3,376,934 A 4/1968 William
3,380,528 A 4/1968 Durwood
3,381,748 A 5/1968 Peters et al.
3,382,925 A 5/1968 Jennings
3,409,084 A 11/1968 Lawson, Jr. et al.
3,437,136 A 4/1969 Young
3,554,278 A 1/1971 Reistle
3,667,721 A 6/1972 Vujasinovic
3,747,674 A 7/1973 Murray
3,752,230 A 8/1973 Bernat et al.
3,897,038 A 7/1975 Le Rouax
3,915,426 A 10/1975 Le Rouax
3,955,622 A 5/1976 Jones
4,030,354 A 6/1977 Scott
4,039,237 A 8/1977 Cullen et al.
4,039,798 A 8/1977 Lyhall et al.
4,042,019 A 8/1977 Henning
4,059,155 A 11/1977 Greer
4,099,699 A 7/1978 Allen
4,190,112 A 2/1980 Davis
4,215,747 A 8/1980 Cox
4,227,573 A 10/1980 Pearce et al.
4,254,983 A 3/1981 Harris
4,276,931 A 7/1981 Murray
4,285,400 A 8/1981 Mullins
4,289,200 A 9/1981 Fisher
4,296,822 A 10/1981 Ormsby
4,325,534 A 4/1982 Roark et al.
4,349,071 A 9/1982 Fish
4,391,326 A 7/1983 Greenlee
4,407,367 A 10/1983 Kydd
4,412,130 A 10/1983 Winters
4,413,642 A 11/1983 Smith et al.
4,422,948 A 12/1983 Corley et al.
4,467,996 A 8/1984 Baugh
4,478,286 A 10/1984 Fineberg
4,515,212 A 5/1985 Krugh
4,538,684 A 9/1985 Sheffield
4,562,888 A 1/1986 Collet
4,603,578 A 8/1986 Stolz
4,611,658 A 9/1986 Salerni et al.
4,616,721 A 10/1986 Furse
4,696,502 A 9/1987 Desai
4,791,992 A 12/1988 Greenlee et al.
4,834,184 A 5/1989 Streich et al.
4,836,289 A 6/1989 Young
4,869,321 A 9/1989 Hamilton
4,877,085 A 10/1989 Pullig, Jr.
4,898,240 A 2/1990 Wittrisch
4,898,245 A 2/1990 Braddick
4,928,762 A 5/1990 Mamke
4,953,617 A 9/1990 Ross et al.
4,997,225 A 3/1991 Denis
5,012,863 A 5/1991 Springer
5,013,005 A 5/1991 Nance
5,054,833 A 10/1991 Bishop et al.
5,060,737 A 10/1991 Mohn
5,117,909 A 6/1992 Wilton et al.
5,129,956 A 7/1992 Christopher et al.
5,176,208 A 1/1993 Lalande et al.
5,178,219 A 1/1993 Streich et al.
5,197,547 A 3/1993 Morgan
5,203,646 A 4/1993 Landsberger et al.
5,295,541 A 3/1994 Ng et al.
5,330,000 A 7/1994 Givens et al.
5,343,946 A 9/1994 Morrill
5,348,095 A 9/1994 Worrall
5,358,048 A 10/1994 Brooks
5,392,715 A 2/1995 Pelrine
5,456,312 A 10/1995 Lynde et al.
5,468,153 A 11/1995 Brown et al.
5,507,346 A 4/1996 Gano et al.
5,580,114 A 12/1996 Palmer
5,584,342 A 12/1996 Swinford
5,605,366 A 2/1997 Beeman
5,639,135 A 6/1997 Beeman
5,667,015 A 9/1997 Harestad et al.
5,673,754 A 10/1997 Taylor
5,678,635 A 10/1997 Dunlap et al.
5,685,982 A 11/1997 Foster
5,697,441 A 12/1997 Vercaemer et al.
5,698,814 A 12/1997 Parsons
5,704,426 A 1/1998 Rytlewski et al.
5,775,420 A 7/1998 Mitchell et al.
5,806,596 A 9/1998 Hardy et al.
5,833,001 A 11/1998 Song et al.
5,842,518 A 12/1998 Soybel et al.
5,875,841 A 3/1999 Wright et al.
5,881,816 A 3/1999 Wright
5,887,668 A 3/1999 Haugen et al.
5,899,796 A 5/1999 Kamiyama et al.
5,924,489 A 7/1999 Hatcher
5,931,443 A 8/1999 Corte, Sr.
5,944,101 A 8/1999 Hearn
5,996,712 A 12/1999 Boyd
6,070,665 A 6/2000 Singleton et al.
6,112,809 A 9/2000 Angle
6,130,615 A 10/2000 Poteet
6,131,675 A 10/2000 Anderson
6,138,764 A 10/2000 Scarsdale et al.
6,155,428 A 12/2000 Bailey et al.
6,247,542 B1 6/2001 Kruspe et al.
6,276,452 B1 8/2001 Davis et al.

(56) References Cited

U.S. PATENT DOCUMENTS 6,371,204 B1 4/2002 Singh et al.
6,378,627 B1 4/2002 Tubel et al.
6,484,816 B1 11/2002 Koederitz
6,491,108 B1 12/2002 Slup et al.
6,510,900 B2 1/2003 Dallas
6,510,947 B1 1/2003 Schulte et al.
6,595,289 B2 7/2003 Tumlin et al.
6,637,511 B2 10/2003 Linaker
6,679,330 B1 1/2004 Compton et al.
6,681,858 B2 1/2004 Streater
6,688,386 B2 2/2004 Cornelssen
6,698,712 B2 3/2004 Milberger et al.
6,729,392 B2 5/2004 DeBerry et al.
6,768,106 B2 7/2004 Gzara et al.
6,808,023 B2 10/2004 Smith et al.
6,811,032 B2 11/2004 Schulte et al.
6,854,521 B2 2/2005 Echols et al.
6,880,639 B2 4/2005 Rhodes et al.
6,899,178 B2 5/2005 Tubel
6,913,084 B2 7/2005 Boyd
7,049,272 B2 5/2006 Sinclair et al.
7,051,810 B2 5/2006 Halliburton
7,082,994 B2 8/2006 Frost, Jr. et al.
7,090,019 B2 8/2006 Barrow et al.
7,096,950 B2 8/2006 Howlett et al.
7,117,941 B1 10/2006 Gano
7,117,956 B2 10/2006 Grattan et al.
7,128,146 B2 10/2006 Baugh
7,150,328 B2 12/2006 Marketz et al.
7,174,764 B2 2/2007 Oosterling et al.
7,188,674 B2 3/2007 McGavern, III et al.
7,188,675 B2 3/2007 Reynolds
7,218,235 B1 5/2007 Rainey
7,231,975 B2 6/2007 Lavaure et al.
7,249,633 B2 7/2007 Ravensbergen et al.
7,267,179 B1 9/2007 Abel
7,275,591 B2 10/2007 Allen et al.
7,284,611 B2 10/2007 Reddy et al.
7,303,010 B2 12/2007 de Guzman et al.
7,334,634 B1 2/2008 Abel
7,363,860 B2 4/2008 Wilson
7,383,889 B2 6/2008 Ring
7,389,817 B2 6/2008 Almdahl
7,398,832 B2 7/2008 Brisco
7,405,182 B2 7/2008 Verrett
7,418,860 B2 9/2008 Austerlitz et al.
7,424,909 B2 9/2008 Roberts et al.
7,448,446 B2 11/2008 Campbell
7,487,837 B2 2/2009 Bailey et al.
7,488,705 B2 2/2009 Reddy et al.
7,497,260 B2 3/2009 Telfer
7,533,731 B2 5/2009 Corre
7,591,305 B2 9/2009 Brookey et al.
7,600,572 B2 10/2009 Slup et al.
7,617,876 B2 11/2009 Patel et al.
7,621,324 B2 11/2009 Atencio
7,712,527 B2 5/2010 Roddy
7,730,974 B2 6/2010 Minshull
7,735,564 B2 6/2010 Guerrero
7,762,323 B2 7/2010 Frazier
7,762,330 B2 7/2010 Saylor, III et al.
7,802,621 B2 9/2010 Richards et al.
7,878,240 B2 2/2011 Garcia
7,934,552 B2 5/2011 La Rovere
7,965,175 B2 6/2011 Yamano
8,002,049 B2 8/2011 Keese et al.
8,056,621 B2 11/2011 Ring et al.
8,069,916 B2 12/2011 Giroux et al.
8,157,007 B2 4/2012 Nicolas
8,201,693 B2 6/2012 Jan
8,210,251 B2 7/2012 Lynde et al.
8,376,051 B2 2/2013 McGrath et al.
8,424,611 B2 4/2013 Smith et al.
8,453,724 B2 6/2013 Zhou
8,496,055 B2 7/2013 Mootoo et al.
8,579,024 B2 11/2013 Mailand et al.
8,579,037 B2 11/2013 Jacob
8,596,463 B2 12/2013 Burkhard
8,662,182 B2 3/2014 Redlinger et al.
8,708,043 B2 4/2014 Mosing et al.
8,726,983 B2 5/2014 Khan
8,770,276 B1 7/2014 Nish et al.
8,899,338 B2 12/2014 Elsayed et al.
8,991,489 B2 3/2015 Redlinger et al.
9,079,222 B2 7/2015 Burnett et al.
9,109,433 B2 8/2015 DiFoggio et al.
9,133,671 B2 9/2015 Kellner
9,163,469 B2 10/2015 Broussard et al.
9,181,782 B2 11/2015 Berube et al.
9,200,486 B2 12/2015 Leveau et al.
9,212,532 B2 12/2015 Leuchtenberg et al.
9,234,394 B2 1/2016 Wheater et al.
9,303,482 B2 4/2016 Hall et al.
9,353,589 B2 5/2016 Hekelaar
9,359,861 B2 6/2016 Burgos
9,410,066 B2 8/2016 Ghassemzadeh
9,416,617 B2 8/2016 Wiese et al.
9,441,441 B1 9/2016 Hickie
9,441,451 B2 9/2016 Jurgensmeier
9,476,279 B2 10/2016 Bailey et al.
9,528,354 B2 12/2016 Loiseau et al.
9,551,200 B2 1/2017 Read et al.
9,574,417 B2 2/2017 Laird et al.
9,617,829 B2 4/2017 Dale et al.
9,624,746 B2 4/2017 Hendel et al.
9,637,977 B2 5/2017 Giroux et al.
9,657,213 B2 5/2017 Murphy et al.
9,784,073 B2 10/2017 Bailey et al.
9,903,192 B2 2/2018 Entchev
9,976,407 B2 5/2018 Ash et al.
10,024,154 B2 7/2018 Gray et al.
10,087,752 B2 10/2018 Bedonet
10,161,194 B2 12/2018 Clemens et al.
10,198,929 B2 2/2019 Snyder
10,202,817 B2 2/2019 Arteaga
10,266,698 B2 4/2019 Cano et al.
10,280,706 B1 5/2019 Sharp, III
10,301,898 B2 5/2019 Orban
10,301,989 B2 5/2019 Imada
10,400,552 B2 9/2019 Gilmore
10,544,640 B2 1/2020 Hekelaar et al.
10,584,546 B1 3/2020 Ford
10,626,698 B2 4/2020 Al-Mousa et al.
10,787,888 B2 9/2020 Andersen
10,837,254 B2 11/2020 Al-Mousa et al.
10,954,739 B2 3/2021 Sehsah et al.
10,975,654 B1 4/2021 Neacsu et al.
10,982,504 B2 4/2021 Al-Mousa et al.
11,008,824 B2 5/2021 Al-Mousa et al.
11,035,190 B2 6/2021 Neascu et al.
11,136,849 B2 10/2021 Al-Mousa et al.
11,142,976 B2 10/2021 Al-Mousa et al.
11,156,052 B2 10/2021 Al-Mousa et al.
2002/0053428 A1 5/2002 Maples
2002/0060079 A1 5/2002 Metcalfe
2002/0129945 A1 9/2002 Brewer et al.
2002/0195252 A1 12/2002 Maguire
2003/0047312 A1 3/2003 Bell
2003/0098064 A1 5/2003 Kohli et al.
2003/0132224 A1 7/2003 Spencer
2003/0150608 A1 8/2003 Smith
2003/0221840 A1 12/2003 Whitelaw
2004/0031940 A1 2/2004 Biester
2004/0040707 A1 3/2004 Dusterhoft et al.
2004/0065446 A1 4/2004 Tran et al.
2004/0074819 A1 4/2004 Burnett
2004/0095248 A1 5/2004 Mandel
2004/0168796 A1 9/2004 Baugh et al.
2004/0216891 A1 11/2004 Maguire
2005/0024231 A1 2/2005 Fincher et al.
2005/0029015 A1 2/2005 Burnett et al.
2005/0056427 A1 3/2005 Clemens et al.
2005/0087585 A1 4/2005 Copperthite et al.
2005/0167097 A1 8/2005 Sommers et al.

(56) References Cited

U.S. PATENT DOCUMENTS

2005/0263282 A1 12/2005 Jeffrey et al.
2006/0082462 A1 4/2006 Crook
2006/0105896 A1 5/2006 Smith et al.
2006/0243453 A1 11/2006 McKee
2007/0114039 A1 5/2007 Hobdy et al.
2007/0137528 A1 6/2007 Le Roy-Ddelage et al.
2007/0181304 A1 8/2007 Rankin et al.
2007/0182583 A1 8/2007 Feluch et al.
2007/0204999 A1 9/2007 Cowie et al.
2007/0256864 A1 11/2007 Robichaux et al.
2007/0256867 A1 11/2007 DeGeare et al.
2008/0007421 A1 1/2008 Liu et al.
2008/0066912 A1 3/2008 Freyer et al.
2008/0078699 A1 4/2008 Carr
2008/0087439 A1 4/2008 Dallas
2008/0236841 A1 10/2008 Howlett et al.
2008/0251253 A1 10/2008 Lumbye
2008/0314591 A1 12/2008 Hales et al.
2009/0167297 A1 7/2009 Chee et al.
2009/0194290 A1 8/2009 Parks et al.
2009/0250220 A1 10/2009 Stamoulis
2009/0308656 A1 12/2009 Chitwood
2010/0051265 A1 3/2010 Hurst
2010/0193124 A1 8/2010 Nicolas
2010/0258289 A1 10/2010 Lynde et al.
2010/0263856 A1 10/2010 Lynde et al.
2010/0270018 A1 10/2010 Howlett
2011/0036570 A1 2/2011 La Rovere et al.
2011/0056681 A1 3/2011 Khan
2011/0067869 A1 3/2011 Bour et al.
2011/0168411 A1 7/2011 Braddick
2011/0203794 A1 8/2011 Moffitt et al.
2011/0259609 A1 10/2011 Hessels et al.
2011/0273291 A1 11/2011 Adams
2011/0278021 A1 11/2011 Travis et al.
2012/0012335 A1 1/2012 White et al.
2012/0067447 A1 3/2012 Ryan et al.
2012/0085538 A1 4/2012 Guerrero
2012/0118571 A1 5/2012 Zhou
2012/0170406 A1 7/2012 DiFoggio et al.
2012/0205908 A1 8/2012 Fischer et al.
2012/0241146 A1 9/2012 Unnphries
2012/0285684 A1 11/2012 Crow et al.
2013/0000864 A1 1/2013 Dirksen et al.
2013/0008647 A1 1/2013 Dirksen
2013/0062055 A1 3/2013 Tolman
2013/0134704 A1 5/2013 Klimack
2013/0140022 A1 6/2013 Leighton
2013/0213654 A1 8/2013 Dewey et al.
2013/0240207 A1 9/2013 Frazier
2013/0269097 A1 10/2013 Alammari
2013/0296199 A1 11/2013 Ghassemzadeh
2013/0299194 A1 11/2013 Bell
2014/0034317 A1* 2/2014 Hekelaar ..... E21B 17/1078 166/55.7
2014/0090898 A1 4/2014 Moriarty
2014/0138091 A1 5/2014 Fuhst
2014/0158350 A1 6/2014 Castillo et al.
2014/0175689 A1 6/2014 Mussig
2014/0231068 A1 8/2014 Isaksen
2014/0251616 A1 9/2014 O'Rourke et al.
2015/0013994 A1 1/2015 Bailey et al.
2015/0096738 A1 4/2015 Atencio
2015/0152704 A1 6/2015 Tunget
2015/0275649 A1 10/2015 Orban
2015/0292317 A1 10/2015 Flores et al.
2015/0354306 A1* 12/2015 Fuller ..... E21B 17/1078 166/55.7
2016/0076327 A1 3/2016 Glaser et al.
2016/0084034 A1 3/2016 Roane et al.
2016/0130914 A1 5/2016 Steele
2016/0160106 A1 6/2016 Jamison et al.
2016/0237810 A1 8/2016 Beaman et al.
2016/0281458 A1 9/2016 Greenlee
2016/0305215 A1 10/2016 Harris et al.
2016/0340994 A1 11/2016 Ferguson et al.
2017/0044864 A1 2/2017 Sabins et al.
2017/0058628 A1 3/2017 Wijk et al.
2017/0067313 A1 3/2017 Connell et al.
2017/0074061 A1 3/2017 Goldspink
2017/0089166 A1 3/2017 Sullivan
2017/0159362 A1 6/2017 Janes
2017/0254179 A1 9/2017 Horwell et al.
2018/0010418 A1 1/2018 VanLue
2018/0030809 A1 2/2018 Harestad et al.
2018/0058167 A1 3/2018 Finol et al.
2018/0175545 A1 6/2018 Engel et al.
2018/0187498 A1 7/2018 Soto et al.
2018/0209565 A1 7/2018 Lingnau
2018/0223616 A1* 8/2018 Messa ..... E21B 10/26
2018/0245427 A1 8/2018 Jimenez et al.
2018/0252069 A1 9/2018 Abdollah et al.
2018/0340381 A1 11/2018 Zhou
2018/0355711 A1 12/2018 Padden
2019/0024473 A1 1/2019 Arefi
2019/0049017 A1 2/2019 McAdam et al.
2019/0087548 A1 3/2019 Bennett et al.
2019/0093475 A1 3/2019 Nyhavn et al.
2019/0186232 A1 6/2019 Ingram
2019/0203551 A1 7/2019 Davis et al.
2019/0284894 A1 9/2019 Schmidt et al.
2019/0284898 A1 9/2019 Fagna et al.
2019/0301258 A1 10/2019 Li
2019/0316424 A1 10/2019 Robichaux et al.
2019/0338615 A1 11/2019 Landry
2020/0032604 A1* 1/2020 Al-Ramadhan ..... E21B 31/18
2020/0032648 A1 1/2020 Lu et al.
2020/0056446 A1 2/2020 Al-Mousa et al.
2020/0115976 A1 4/2020 Zeidler
2020/0240225 A1 7/2020 King et al.
2020/0325741 A1 10/2020 Hutchinson et al.
2021/0025259 A1 1/2021 Al-Mousa et al.
2021/0054696 A1 2/2021 Golinowski et al.
2021/0054706 A1 2/2021 Al-Mousa et al.
2021/0054708 A1 2/2021 Al-Mousa et al.
2021/0054710 A1 2/2021 Neacsu et al.
2021/0054716 A1 2/2021 Al-Mousa et al.
2021/0131212 A1 5/2021 Al-Mousa et al.
2021/0131215 A1 5/2021 Al-Mousa et al.
2021/0140267 A1 5/2021 Al-Mousa et al.
2021/0198965 A1 7/2021 Al-Mousa et al.
2021/0215013 A1 7/2021 Neacsu et al.
2021/0230960 A1 7/2021 Al-Mousa
2021/0262296 A1 8/2021 Al-Mousa
2021/0262307 A1 8/2021 Neacsu
2021/0293094 A1 9/2021 Al-Mousa et al.
2021/0293135 A1 9/2021 Al-Mousa et al.

FOREIGN PATENT DOCUMENTS

AU 2012230084 9/2012
CA 1329349 5/1994
CA 2441138 3/2004
CA 2624368 4/2011
CA 2762217 5/2015
CA 2802988 10/2015
CA 2879985 4/2016
CA 2734032 6/2016
CN 203292820 11/2013
CN 105436067 3/2016
CN 103785923 6/2016
CN 104712320 12/2016
CN 107060679 8/2017
CN 107191152 9/2017
CN 107227939 10/2017
CN 108756851 11/2018
DK 2545245 4/2017
DK 2236742 8/2017
EP 0792997 1/1999
EP 1340882 10/2005
EP 2119867 11/2009
EP 2737172 6/2014
EP 2964874 1/2016
EP 2545245 4/2017

(56) References Cited

FOREIGN PATENT DOCUMENTS

| | | | |
|---|---|---|---|
| ES | 2275961 | T5 | 3/2011 |
| GB | 958734 | | 5/1964 |
| GB | 2021178 | | 11/1979 |
| GB | 2203602 | | 10/1988 |
| GB | 2392183 | | 2/2004 |
| GB | 2396634 | | 6/2004 |
| GB | 2414586 | | 11/2005 |
| GB | 2425138 | | 10/2006 |
| GB | 2427214 | | 12/2006 |
| GB | 2453279 | | 1/2009 |
| GB | 2492663 | | 1/2014 |
| GB | 2546996 | | 8/2017 |
| JP | 2001271982 | | 10/2001 |
| NO | 333538 | | 7/2013 |
| NO | 20170293 | | 8/2018 |
| OA | 5503 | A | 4/1981 |
| RU | 2669969 | | 10/2018 |
| TW | 201603922 | | 2/2016 |
| TW | 201622853 | | 7/2016 |
| WO | WO 1989012728 | | 12/1989 |
| WO | WO 1996039570 | | 12/1996 |
| WO | WO 2002090711 | | 11/2002 |
| WO | WO 2004046497 | | 6/2004 |
| WO | WO 2010132807 | | 11/2010 |
| WO | WO 2012161854 | | 11/2012 |
| WO | WO 2012164023 | | 12/2012 |
| WO | WO 2013109248 | | 7/2013 |
| WO | WO 2015112022 | | 7/2015 |
| WO | WO 2016011085 | | 1/2016 |
| WO | WO 2016040310 | | 3/2016 |
| WO | WO 2016140807 | | 9/2016 |
| WO | WO 2017043977 | | 3/2017 |
| WO | WO 2018017104 | | 1/2018 |
| WO | WO 2018164680 | | 9/2018 |
| WO | WO 2019027830 | | 2/2019 |
| WO | WO 2019132877 | | 7/2019 |
| WO | WO 2019231679 | | 12/2019 |

OTHER PUBLICATIONS

Al-Ibrahim et al., "Automated Cyclostratigraphic Analysis in Carbonate Mudrocks Using Borehole Images," Article #41425, posted presented at the 2014 AAPG Annual Convention and Exhibition, Search and Discovery, Apr. 6-9, 2014, 4 pages.

Bautista et al., "Probability-based Dynamic TimeWarping for Gesture Recognition on RGB-D data," WDIA 2012: Advances in Depth Image Analysis and Application, International Workshop on Depth Image Analysis and Applications, 2012, 126-135, 11 pages.

Boriah et al., "Similarity Measures for Categorical Data: A Comparative Evaluation," presented at the SIAM International Conference on Data Mining, SDM 2008, Apr. 24-26, 2008, 12 pages.

Bruton et al., "Whipstock Options for Sidetracking," Oilfield Review, Spring 2014, 26:1, 10 pages.

Edwards et al., "Assessing Uncertainty in Stratigraphic Correlation: A Stochastic Method Based on Dynamic Time Warping," RM13, Second EAGE Integrated Reservoir Modelling Conference, Nov. 16-19, 2014, 2 pages.

Edwards, "Construction de modèles stratigraphiques à partir de données éparses," Stratigraphie, Université de Lorraine, 2017, 133 pages, English abstract.

Fischer, "The Lofer Cyclothems of the Alpine Triassic," published in Merriam, Symposium on Cyclic Sedimentation: Kansas Geological Survey (KGS), Bulletin, 1964, 169: 107-149, 50 pages.

Forum Energy Technologies "Drill Pipe Float Valves," 2019, Catalog, 6 pages.

Hernandez-Vela et al., "Probability-based Dynamic Time Warping and Bag-of-Visual-and-Depth-Words for human Gesture Recognition in RGB-D," Pattern Recognition Letters, 2014, 50: 112-121, 10 pages.

Herrera and Bann, "Guided seismic-to-well tying based on dynamic time warping," SEG Las Vegas 2012 Annual Meeting, Nov. 2012, 6 pages.

Hydril "Checkguard" Kellyguard Drill Stem Valves, Catalog DSV 2003, Brochure, 9 pages.

Keogh and Ratanamahatana, "Exact indexing of dynamic time warping," Knowledge and Information Systems, Springer-Verlag London Ltd., 2004, 29 pages.

Lallier et al., "3D Stochastic Stratigraphic Well Correlation of Carbonate Ramp Systems," IPTC 14046, International Petroleum Technology Conference (IPTC), presented at the International Petroleum Technology Conference, Dec. 7-9, 2009, 5 pages.

Lallier et al., "Management of ambiguities in magnetostratigraphic correlation," Earth and Planetary Science Letters, 2013, 371-372: 26-36, 11 pages.

Lallier et al., "Uncertainty assessment in the stratigraphic well correlation of a carbonate ramp: Method and application of the Beausset Basin, SE France," C. R. Geoscience, 2016, 348: 499-509, 11 pages.

Lineman et al., "Well to Well Log Correlation Using Knowledge-Based Systems and Dynamic Depth Warping," SPWLA Twenty-Eighth Annual Logging Symposium, Jun. 29-Jul. 2, 1987, 25 pages.

Nakanishi and Nakagawa, "Speaker-Independent Word Recognition by Less Cost and Stochastic Dynamic Time Warping Method," ISCA Archive, European Conference on Speech Technology, Sep. 1987, 4 pages.

packardusa.com [online], "Drop-in Check Valves," Packard International, available on or before Jul. 6, 2007, via Internet Archive: Wayback Machine URL <http://web.archive.org/web/20070706210423/http://packardusa.com/productsandservices5.asp>, retrieved on May 11, 2021, URL <www.packardusa.com/productsandservices5.asp>, 2 pages.

Pels et al., "Automated biostratigraphic correlation of palynological records on the basis of shapes of pollen curves and evaluation of next-best solutions," Paleogeography, Paleoclimatology, Paleoecology, 1996, 124: 17-37, 21 pages.

Pollack et al., "Automatic Well Log Correlation," AAPG Annual Convention and Exhibition, Apr. 3, 2017, 1 page, Abstract Only.

Rudman and Lankston, "Stratigraphic Correlation of Well Logs by Computer Techniques," The American Association of Petroleum Geologists, Mar. 1973, 53:3 (557-588), 12 pages.

Sakoe and Chiba, "Dynamic Programming Algorithm Optimization for Spoken Word Recognition," IEEE Transactions on Acoustics, Speech and Signal Processing, ASSP-26:1, Feb. 1978, 7 pages.

Salvador and Chan, "FastDTW: Toward Accurate Dynamic Time Warping in Linear Time and Space," presented at the KDD Workshop on Mining Temporal and Sequential Data, Intelligent Data Analysis, Jan. 2004, 11:5 (70-80), 11 pages.

Sayhi, "peakdet: Peak detection using MATLAB," Jul. 2012, 4 pages.

Scribd.com [online], "Milling Practices and Procedures," retrieved from URL <https://www.scribd.com/document/358420338/Milling-Rev-2-Secured>, 80 pages.

Silva and Koegh, "Prefix and Suffix Invariant Dynamic Time Warping," IEEE Computer Society, presented at the IEEE 16th International Conference on Data Mining, 2016, 6 pages.

Smith and Waterman, "New Stratigraphic Correlation Techniques," Journal of Geology, 1980, 88: 451-457, 8 pages.

Startzman and Kuo, "A Rule-Based System for Well Log Correlation," SPE Formative Evaluation, Society of Petroleum Engineers (SPE), Sep. 1987, 9 pages.

TAM International Inflatable and Swellable Packers, "TAM Scab Liner brochure," Tam International, available on or before Nov. 15, 2016, 4 pages.

Tomasi et al., "Correlation optimized warping and dynamic time warping as preprocessing methods for chromatographic data," Journal of Chemometrics, 2004, 18: 231-241, 11 pages.

Uchida et al., "Non-Markovian Dynamic Time Warping," presented at the 21st International Conference on Pattern Recognition (ICPR), Nov. 11-15, 2012, 4 pages.

Waterman and Raymond, "The Match Game: New Stratigraphic Correlation Algorithms," Mathematical Geology, 1987, 19:2, 19 pages.

Weatherford, "Micro-Seal Isolation System-Bow (MSIS-B)," Weatherford Swellable Well Construction Products, Brochure, 2009-2011, 2 pages.

(56) References Cited

OTHER PUBLICATIONS

Zoraster et al., "Curve Alignment for Well-to-Well Log Correlation," SPE 90471, Society of Petroleum Engineers (SPE), presented at the SPE Annual Technical Conference and Exhibition, Sep. 26-29, 2004, 6 pages.

* cited by examiner

DOWNHOLE MILLING SYSTEM

TECHNICAL FIELD

The present disclosure generally relates to downhole milling tools and methods, more particularly, tools and methods for milling tubular components in a wellbore or casing.

BACKGROUND

Drilling, operating, and maintaining wellbores includes placing tubular members within the wellbore. For example, production tools, packers, and other tubular components can be used in a wellbore and can become stuck, permanently fixed, abandoned, or otherwise left in the wellbore. Milling tools are used to mill and remove components in a wellbore.

SUMMARY

This disclosure describes well tools for milling tubular components in a wellbore.

Some aspects of the disclosure encompass a well tool for milling a tubular. The well tool includes a well tubing configured to be disposed in a wellbore, the well tubing including a circulation fluid pathway through an interior of the well tubing, a first milling tool coupled to the well tubing at a first longitudinal end of the well tubing, a second milling tool coupled to the well tubing at a location longitudinally uphole from the first milling tool, and a third milling tool coupled to the well tubing at a location longitudinally uphole from the second milling tool. The first milling tool includes a first mill bit and a first circulation sub fluidly connected to the circulation fluid pathway, and the first milling tool is configured to mill a first portion of the tubular. The second milling tool includes a second mill bit and a second circulation sub fluidly connected to the circulation fluid pathway, and the second milling tool is configured to mill a second portion of the tubular. The third milling tool includes a third mill bit and a third circulation sub fluidly connected to the circulation fluid pathway, and the third milling tool is configured to mill a third portion of the tubular.

This, and other aspects, can include one or more of the following features. The first mill bit can include a first milling surface having a first outer diameter, the second mill bit can include a second milling surface with a second outer diameter, and the third mill bit can include a third milling surface with a third outer diameter. The first outer diameter, second outer diameter, and third outer diameter can be the same. At least one of the first mill bit, the second mill bit, or the third mill bit can include a pilot-type mill bit. The first mill bit can include a flat-bottom milling surface, and at least one of the second mill bit or the third mill bit can include the pilot-type mill bit. The first circulation sub can include a first circulation port to fluidly couple the circulation fluid pathway to an annulus of the wellbore downhole of the first mill bit. The second circulation sub can include a second circulation port through an exterior wall of the second circulation sub downhole of the second mill bit, where the second circulation port fluidly couples the circulation fluid pathway to the annulus downhole of the second mill bit, and the third circulation sub can include a third circulation port through an exterior wall of the third circulation sub downhole of the third mill bit, where the third circulation port fluidly couples the circulation fluid pathway to the annulus downhole of the third mill bit. The first circulation sub can include a first cylindrical body and a first plug seat to receive a first dropped plug and plug the first circulation port. The second circulation sub can include a first cylindrical body and a first sleeve valve within the first cylindrical body, where the first sleeve valve includes a first plug seat to receive a first dropped plug and selectively open the second circulation port. The third circulation sub can include a second cylindrical body and a second sleeve valve within the cylindrical body, the second sleeve valve including a second plug seat to receive a second dropped plug and selectively open the third circulation port. A first bore diameter of the first plug seat can be less than a second bore diameter of the second plug seat.

Some aspects of the disclosure encompass a method for milling a tubular in a wellbore. The method includes disposing a well tool in a wellbore, where the well tool includes a well tubing having a circulation fluid pathway through the well tubing, and milling the tubular in the wellbore with a first mill bit of the well tool until the first mill bit is at least partially consumed. The first mill bit is coupled to the well tubing proximate to a first longitudinal end of the well tubing. After milling the tubular until the first mill bit is at least partially consumed, the method includes lowering the well tool into the wellbore to dispose the first mill bit within the tubular, and after lowering the well tool, milling the tubular in the wellbore with a second mill bit of the well tool. The second mill bit is coupled to the well tubing at a location longitudinally uphole of the first mill bit.

This, and other aspects, can include one or more of the following features. Milling the tubular with the first mill bit can include flowing a circulation fluid to the first mill bit through a first circulation port in a first circulation sub at the first mill bit, the first circulation port fluidly connecting the circulation fluid pathway to an annulus of the wellbore, and the method can further include, after milling the tubular with the first mill bit until the first mill bit is at least partially consumed, plugging flow to the first circulation port with a first dropped plug. The first circulation sub can include a first cylindrical body and a first sleeve valve including a first plug seat, and plugging flow to the first circulation port with the first dropped plug can include engaging the first plug seat with the first dropped plug and sliding the first sleeve valve from a first, open position to a second, closed position of the first sleeve valve to plug the first circulation port. Milling the tubular with the second mill bit can include flowing the circulation fluid to the second mill bit through a second circulation port in a second circulation sub at the second mill bit, the second circulation port located downhole of the second mill bit and configured to flow the circulation fluid from within the second circulation sub to the annulus of the wellbore proximate to the second mill bit. The second circulation sub can include a sleeve valve having a plug seat, and plugging flow to the first circulation port with a first dropped plug can include receiving the first dropped plug in the plug seat of the sleeve valve of the second circulation sub, and moving the sleeve valve from a first position to a second position to open the second circulation port to the flow of circulation fluid. Milling the tubular with the second mill bit can include milling the tubular until the second mill bit is at least partially consumed, and the method can further include, after milling the tubular until the second mill bit is at least partially consumed, lowering the well tool into the wellbore to dispose the second mill bit within the tubular, and after lowering the well tool, milling the tubular in the wellbore with a third mill bit of the well tool, the third mill bit being coupled to the well tubing at a location longitudinally uphole from the second mill bit. The method can further include, after milling the tubular with the second mill bit until the second mill bit is at least partially consumed, plugging the second circulation port with a second dropped plug, and milling the tubular with the third mill bit can include flowing the circulation fluid to the third mill bit through a third circulation port in a third circulation sub at the third mill bit, the third circulation port located downhole of the third mill bit and configured to flow the circulation fluid from within the third circulation sub to the annulus of the wellbore proximate to the third mill bit. The third circulation sub can include a second sleeve valve having a second plug seat, and plugging the second circulation port with the second dropped plug can include receiving the second dropped plug in the second plug seat of the second sleeve valve of the third circulation sub, and moving the sleeve valve from a first position to a second position to open the third circulation port to the flow of circulation fluid. When the second mill bit mills the tubular in the wellbore, the first mill bit has been consumed, and the third mill bit is outside of the tubular. When the first mill bit mills the tubular in the wellbore, the second mill bit is outside of the tubular.

In certain aspects, a well tool for milling a tubular includes a drill pipe configured to be disposed in a wellbore, where the drill pipe includes a circulation fluid pathway through an interior of the drill pipe, a first milling tool coupled to the drill pipe at a first longitudinal end of the drill pipe, and a second milling tool coupled to the drill pipe at a location longitudinally uphole from the first milling tool. The first milling tool includes a first mill bit and a first circulation sub fluidly connected to the circulation fluid pathway, and the second milling tool includes a second mill bit and a second circulation sub fluidly connected to the circulation fluid pathway.

This, and other aspects, can include one or more of the following features. The first mill bit can include a first milling surface having a first outer diameter, the second mill bit can include a second milling surface with a second outer diameter, and the first outer diameter can be the same as the second outer diameter. The first circulation sub can include a first circulation port to fluidly couple the circulation fluid pathway to an annulus of the wellbore downhole of the first mill bit, and the second circulation sub can include a second circulation port through an exterior wall of the second circulation sub downhole of the second mill bit, where the second circulation port fluidly couples the circulation fluid pathway to the annulus downhole of the second mill bit. The second circulation sub can include a cylindrical body and a sleeve valve within the cylindrical body, where the sleeve valve includes a plug seat to receive a dropped plug and selectively open the second circulation port.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
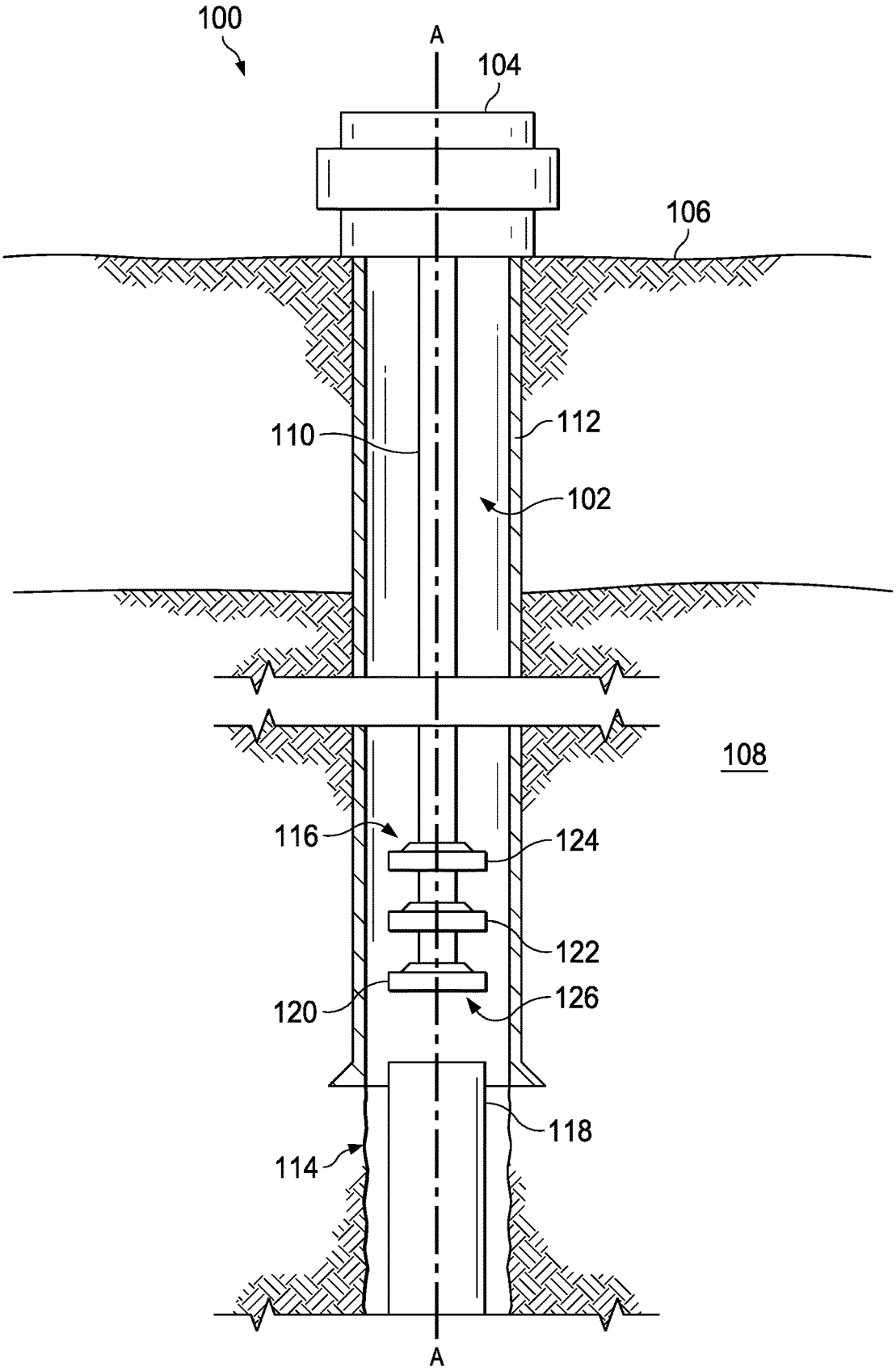
FIG. 1 is a schematic, partial cross-sectional side view of an example well system including an example well tool.

This disclosure describes a downhole well tool for milling and workover operations. The well tool includes a well tubing, such as a drill pipe, carrying multiple mills, and each mill includes a mill bit and a respective circulation sub through which fluid flows from the surface to the respective mill bit, for example, to cool the surface being milled, to cool the milling surface of the respective mill bit, to carry milled parts toward the surface through the wellbore (for example, through an annulus of the wellbore that exists between an exterior surface of the well tubing and an inner wall of the wellbore), or a combination of these. The multiple mill bits are longitudinally stacked in series along the well tubing, and adjacent mill bits are separated by one of the respective circulation subs. In some examples, each circulation sub is positioned within or just downhole of a respective mill, and each circulation sub can be ball activated to selectively close circulation ports at the respective circulation sub. A circulation port (or set of circulation ports) can be closed directly using a dropped ball (or other type of dropped plug) that seats in the circulation port, or the circulation port can be closed by moving a ball-activated sliding sleeve from a first position to a second, closed position that covers and plugs the circulation port (or set of circulation ports). For example, a dropped ball (or other type of dropped plug) can travel to and set on a plug seat on the sliding sleeve, the well tubing can be pressured up to a pressure threshold that is sufficient to shear a shear pin or fuse that temporarily holds the sliding sleeve in the open position, and the sliding sleeve can slide within its respective circulation sub adjacent to the circulation port to cover and plug the circulation port from fluid flow.

In some implementations, operation of the milling tool includes lowering the well tool into a wellbore or casing to the top of a tubular profile that needs to be milled. A first mill bit at the downhole end of the drill pipe (or other well tubing) contacts the uphole end of the tubular to be milled. The drill pipe is rotated to perform a milling operation until the first mill bit at the downhole end of the drill pipe wears out, such that the radius of the first mill bit recedes due to wear. Since the worn out first mill bit has reduced in diameter, a drawworks or other operable component at a wellhead of the wellbore can lower the drill pipe further downhole such that the worn out first mill bit is lowered within the tubular. As the drill pipe is lowered, a second mill bit of the well tool contacts the tubular to perform a milling operation. The milling operation is repeated with the second mill bit, and in some instances, a third mill bit or more mill bits disposed on the drill pipe, until the tubular is completely milled. The well tool can also be used to mill multiple tubulars and other components in the wellbore in succession.

Conventional milling tools include a single mill bit on a drill pipe, and a milling tool is run then retried each time the mill bit is consumed. The milling well tool of the present disclosure includes multiple sets of mills stacked on a single drill string, and a milling operation can run the multiple sets of mills in one trip to maximize milling operations, provide for faster milling operations, save rig time, and mill away more material from a well in the single trip, among other benefits.

FIG. 1 is a schematic, partial cross-sectional side view of an example well system 100 that includes a substantially cylindrical wellbore 102 extending from a well head 104 at a surface 106 downward into the Earth into one or more subterranean zones of interest 108 (one shown). The example well system 100 includes a vertical well, with the wellbore 102 extending substantially vertically from the surface 106 to the subterranean zone 108. The concepts herein, however, are applicable to many other different configurations of wells, including horizontal, slanted, or otherwise deviated wells. A well string 110 is shown as having been lowered from the surface 106 into the wellbore 102. In certain instances, after some or all of the wellbore 102 is drilled, a portion of the wellbore 102 is lined with lengths of tubing, called casing 112. The wellbore 102 can be drilled in stages, and the casing 112 may be installed between stages. The casing 112 can include a series of jointed lengths of tubing coupled together end-to-end or a continuous (for example, not jointed) coiled tubing. The casing 112 forms the cased section of the wellbore 102. In some examples, the well system 100 excludes casings, such as casing 112, and the wellbore 102 is at least partially or entirely open bore. The section(s) of the wellbore 102 exposed to the adjacent formation (for example, without casing or other permanent completion) form the open hole section 114 of the wellbore 102.

In the example well system 100 of FIG. 1, the well string 110 connects to and supports a downhole well tool 116 for milling a tubular 118 disposed in the wellbore 102. The downhole well tool 116 includes multiple milling tools (three shown) longitudinally stacked along central axis A-A. In the example well system 100 of FIG. 1, the well tool 116 includes a first milling tool 120, a second milling tool 122, and a third milling tool 124, each of which are coupled to the well string 110. The first milling tool 120 is positioned at a first, downhole longitudinal end 126 of the well string 110, the second milling tool 122 is positioned on the well string 110 longitudinally uphole of the first milling tool 120, and the third milling tool 124 is positioned on the well string 110 longitudinally uphole of the second milling tool 122. While the example well tool 116 of FIG. 1 includes three milling tools, the example well tool 116 can include fewer (for example, two) milling tools or more than three milling tools (for example, four, five, or more milling tools) positioned in longitudinal series along the well string 110. The downhole well tool 116 operates to mill the tubular 118 in sequential stages, starting with the first milling tool 120, then the second milling tool 122, and finally the third milling tool 124. As a milling tool is consumed (partially or completely), its milling surface is reduced such that a thickness and a radius of the mill bit is reduced. For example, a milling tool is consumed when its mill bit wears down such that the radius of the mill bit recedes as a result of the wear. Since a consumed mill bit has a reduced diameter relative to the diameter of an unconsumed mill bit, the mill bit can be lowered further downhole such that the consumed mill bit can reside within a tubular. Once a milling tool is consumed to a threshold diameter, the milling tool is small enough to be disposed within the tubular 118 itself.

The downhole well tool 116 is shown in FIG. 1 as positioned at the first, downhole longitudinal end 126 of the well string 110. However, the location of the well tool 116 on the well string 110 can vary. For example, the downhole well tool 116 can be at an intermediate location on the drill string between an uphole end and the downhole end 126 of the well string 110.

In the example well system 100 of FIG. 1, the well string 110 is made up of well tubing, and can take the form of a drill string (or drill pipe) that can rotate about central axis A-A, for example, to control the milling operations with the well tool 116. The well string 110 can take a variety of other forms, for example, based on any other types of tools carried on the well string 110. In some implementations, the well string 110 is a drill string, production string, a testing string, a wireline, a completion string, or another type of tubing string. Though the example well system 100 of FIG. 1 shows one downhole well tools 116, the number of downhole well tools can vary. For example, the well system 100 can include additional well tools uphole of or downhole of the downhole well tool 116 along the well string 110. The well tool 116 is rugged enough to withstand the harsh wellbore environment and to be included on an active drill string or other well string.

Figure 2:
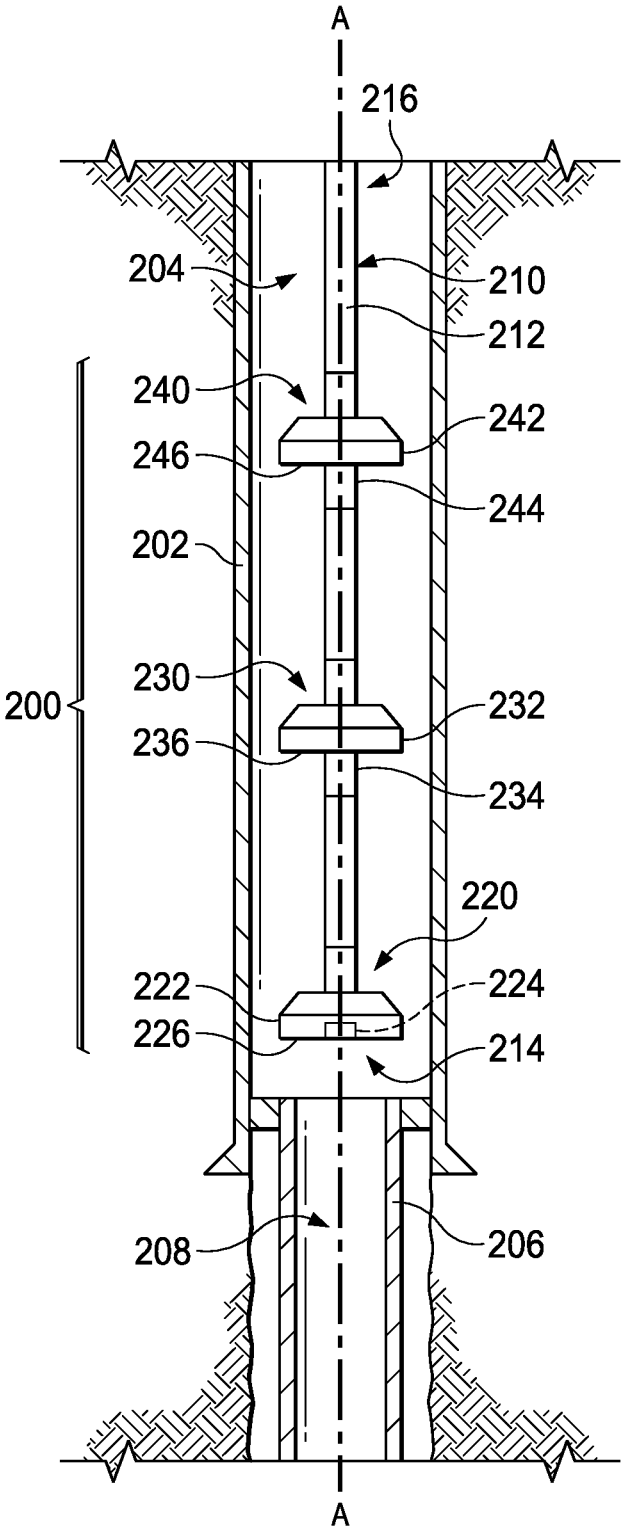
FIG. 2 is a schematic, partial cross-sectional front view of an example well tool disposed in a casing of a wellbore and uphole of a tubular component.

FIG. 2 is a schematic, partial cross-sectional front view of an example well tool 200 disposed in a casing 202 of a wellbore 204 at a longitudinal location uphole of a tubular component 206 to be fished from the wellbore 204. In some instances, the tubular 206 is referred to as a fish, for example, indicating that the tubular 206 is intended to be milled down and fished out of the wellbore 204. In the example well tool 200 of FIG. 2, the tubular component 206 is a tubular casing section coupled to the casing 202 and having a smaller diameter than a diameter of the casing 202. The tubular 206 includes a hollow central bore 208, for example, to receive a portion of the well tool 200 during a milling operation of the well tool 200, describe in more detail later. However, the type of tubular component 206 can vary. For example, the type of tubular component 206 can include a casing, a liner, a tubing section of a well tool, a production casing liner, a production permanent packer, or other components. The example well tool 200 can be used in the example well system 100 of FIG. 1, such as the downhole well tool 116 within the cased wellbore 102 of FIG. 1.

The example well tool 200 includes a well tubing 210 supported from a wellhead (not shown) at the surface of the wellbore 204. In the example well tool 200 of FIG. 2, the well tubing 210 takes the form of a drill pipe, though other types of support well strings can be used to support the example well tool 200. Referring to FIG. 2, the drill pipe 210 includes a circulation fluid pathway 212 through an interior of the drill pipe 210, for example, to supply a circulation fluid to the well tool 200 from the surface or another uphole fluid source. The circulation fluid pathway 212 runs parallel the central longitudinal axis A-A along an interior of the drill pipe 210. The drill pipe 210 can run partially or entirely to the wellhead at the surface of the wellbore 204, for example, from a first downhole longitudinal end 214 of the drill pipe 210 to a second, uphole longitudinal end 216 of the drill pipe 210. The example well tool 200 includes multiple milling tools (three shown), including a first milling tool 220 coupled to the drill pipe 210 at the first longitudinal end 214 of the drill pipe 210, a second milling tool 230 coupled to the drill pipe 210 at a second location that is longitudinally uphole of the first milling tool 220, and a third milling tool 240 coupled to the drill pipe 210 at a third location that is longitudinally uphole of the second milling tool 230. Each of the milling tools includes a mill bit and a circulation sub fluidly connected to the circulation fluid pathway 212. In other words, the first milling tool 220 includes a first mill bit 222 and a first circulation sub 224 fluidly connected to the circulation fluid pathway 212, the second milling tool 230 includes a second mill bit 232 and a second circulation sub 234 fluidly connected to the circulation fluid pathway 212, and the third milling tool 240 includes a third mill bit 242 and a third circulation sub 244 fluidly connected to the circulation fluid pathway 212. The first milling tool 220, second milling tool 230, and third milling tool 240 are spaced from each other along the drill pipe 210 at a defined distance, for example, that is sufficient to allow space for the respective internal circulation subs. In some instances, adjacent milling tools are separated from each other on the drill string at a minimum longitudinal distance such that, when one of the mill bits is completely consumed by a hollow tool (or fish) that is being milled by the mill bit, the consumed mill bit falls into the hollow tool and the drill pipe undergoes a longitudinal drop that is noticeable by a well operator. The noticed drop indicates that the mill bit was consumed, and can also indicate that an adjacent uphole mill bit can be lowered to engage the hollow tool and continue with a milling operation. The distance between the adjacent milling tools can be adjusted.

The respective mill bits (222, 232, 242) each include a milling surface (226, 236, 246, respectively) at a longitudinally downhole end of its respective milling tool (220, 230, 240), which can sequentially engage and mill away all or a portion of the tubular 206. The milling surfaces (226, 236, 246) each have a respective outer diameter, which can be the same or different among the milling tools 220, 230, 240. In the example well tool 200 of FIG. 2, the first outer diameter of the first milling surface 226, the second outer diameter of the second milling surface 236, and the third outer diameter of the third milling surface 246 are the same. In some examples, the milling surfaces (226, 236, 246) can have varying diameters, such as progressively increasing diameters or progressively decreasing diameters between the downhole-most surface and the uphole-most surface. Varying diameters of the milling surfaces can allow for gradual milling of larger holes in a tubular (such as instances where the diameters of the mills gradually increase between the first, downhole mill and the last, uphole mill), or allowing for the milling of different sized tubular profiles of lost downhole tubulars.

The fist mill bit 222, second mill bit 232, and third mill bit 242 can take a variety of shapes and mill types, and each of the mill bits 222, 232, 242 can be the same mill bit type or different mill bit types. In the example well tool 200 of FIG. 2, the first mill bit 222 includes a flat-bottom milling surface, and the second mill bit 232 and the third mill bit 242 each include a pilot-type mill bit, in that a portion of the drill pipe 210 extend longitudinally below the second mill bit 232 and below the third mill bit 242. However, the type of mill bit and milling surface can vary. For example, the example well tool 200 can have a different combination of mill types as desired to mill a downhole tubular profile, and other mill types and mill shapes can be mounted and used in the example well tool 200 in addition to or instead of the mill types depicted in the example well tool 200 of FIG. 2.

The example well tool 200 of FIG. 2 includes three milling tools in a stacked configuration along axis A-A. However, the example well tool 200 can include fewer or more milling tools in the stacked configuration. For example, the well tool 200 can include two milling tools, four milling tools, or five or more milling tools longitudinally stacked along the drill pipe 210.

Figure 3A:
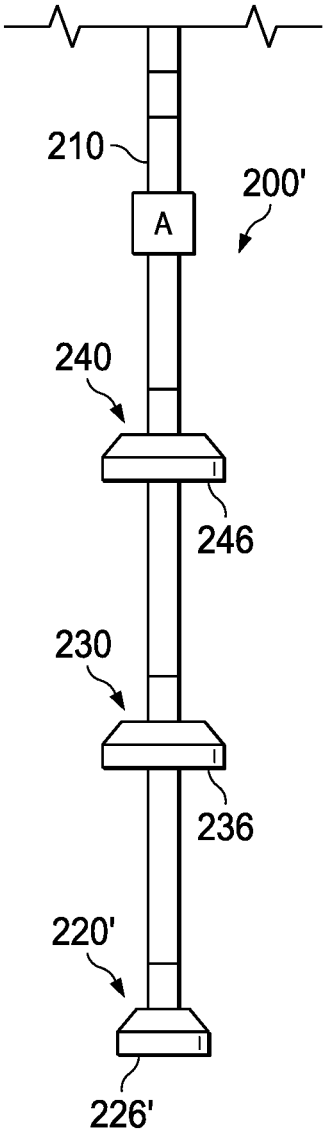
FIGS. 3A-3C are schematic side views of the example well tool of FIG. 2 showing an example milling sequence of the example well tool.
Figure 3B:
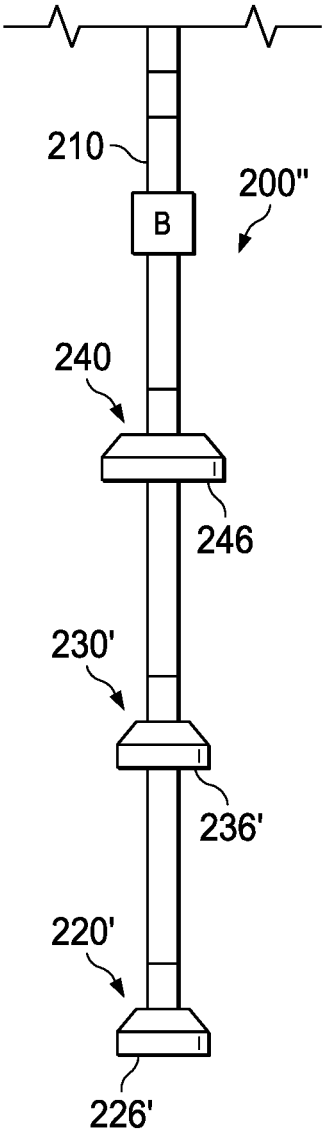
Figure 3C:
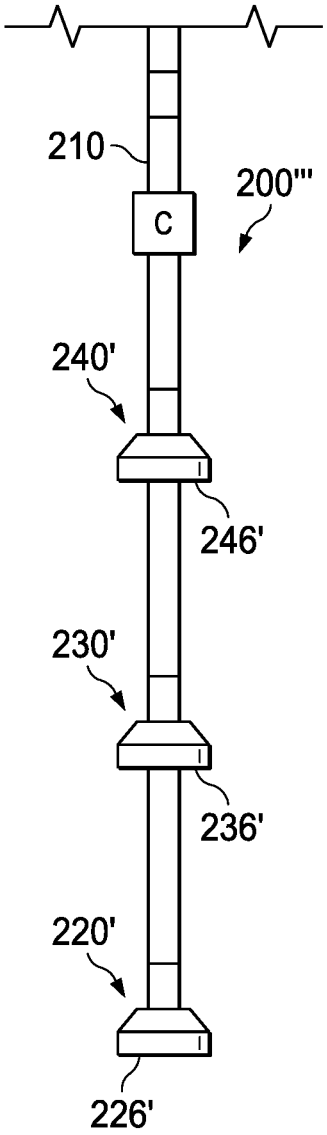

In operation of the example well tool 200, the drill pipe 210 rotates about its central longitudinal axis A-A, and the first milling tool 220, second milling tool 230, and third milling tool 240 sequentially engage and mill down the tubular 206. The milling tools 220, 230, and 240 are longitudinally stacked along the drill pipe 210 in order to mill down the tubular 206 in sequential stages, starting with the first milling tool 220, moving to the second milling tool 230 after the first mill bit 222 is worn down and consumed (partially or completely), then moving to the third milling tool 240 after the second mill bit 232 is worn down and consumed (partially or completely). FIGS. 3A-3C are schematic side views of the example well tool 200 of FIG. 2 showing an example milling sequence of the example well tool 200. For example, FIG. 3A shows the example well tool 200' with the first milling tool 220' worn down after milling a tubular component, such that the first milling surface 226' has an outer diameter that is smaller than the first outer diameter. FIG. 3B shows the example well tool 200" with the second milling tool 230' worn down after milling the tubular component, such that the second milling surface 236' has an outer diameter that is smaller than the second outer diameter. FIG. 3C shows the example well tool 200" with the third milling tool 240' worn down after milling the tubular component, such that the third milling surface 246' has an outer diameter that is smaller than the third outer diameter. FIGS. 3A-3C show an example sequence of a milling operation performed by the example well tool 200 of FIG. 2, which can be performed in a single run in of the well tool 200 in the wellbore 204.

In an example milling operation using the example well tool 200, as the first mill bit 222 wears down the tubular 206, the tubular 206 also wears down the first mill bit 222. As the first mill bit 222 wears down, the material of the first mill bit 222 breaks down. When the material of the first mill bit 222 wears down completely through a thickness of the first mill bit 222, the diameter of the first mill bit 222 is reduced. With the reduced diameter of the first mill bit 222, a drawworks (or other operable equipment at a surface of the well) lowers the first mill bit 222 into the bore 208 of the tubular 206, for example, so that the second mill bit 232 can proceed with continuing to mill the tubular 206 while the first mill bit 222 resides in the bore 208 of the tubular 206. This milling operation is repeated for each sequential mill bit that is coupled to the drill pipe 210 (or until the tubular 206 is completely milled away), for example, so that the tubular 206 can be milled using multiple mill bits and in a single running of the example well tool 200 (or in fewer runnings of well tools relative to multiple runnings of single-bit milling tools). In some implementations, the drawworks (or other component at the wellhead) determines when one of the milling tools tags, or contacts, the tubular 206 by sensing a resistance to downward movement of the example well tool 200. As a milling tool mills the tubular 206, the drawworks, top drive, or other component can sense a downward acceleration or other downward movement of the well tool 200, indicating that the respective milling tool is consumed and can be lowered into the tubular 206. For example, the top drive provides the rotational force to the example well tool 200 to drive the milling operation that mills the downhole tubular profiles, and the top drive can also longitudinally push and pull the example well tool 200 (for example, along axis A-A). The depths of the respective milling tools of the example well tool 200 is known, for example, since the depths are recorded as the example well tool 200 enters the wellbore at the surface of the well.

Figure 4A:
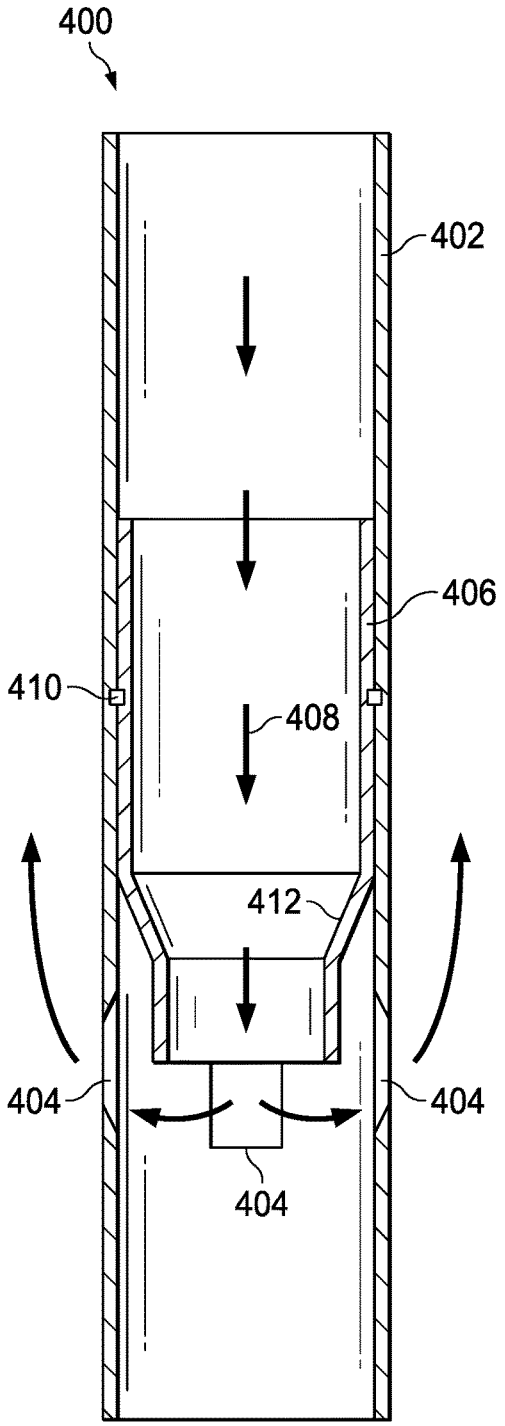
FIGS. 4A-4D are partial cross-sectional schematic views of an example circulation sub during a plugging operation.

The first circulation sub 224, second circulation sub 234, and third circulation sub 244 each include a circulation port or set of circulation ports that fluidly connect and direct a flow of the circulation fluid from the circulation fluid pathway 212 of the drill pipe 210 to an annulus of the wellbore 102 proximate to the respective mill bits 222, 232, 242 during a milling operation of the respective mill bits 222, 232, 242. The circulation ports are selectively controllable, for example, so that the milling tool that is milling a tubular component receives the flow of circulation fluid, while a worn out milling tool that is not actively milling the component does not receive a flow of the circulation fluid. FIG. 4A is a partial cross-sectional schematic view of an example circulation sub 400 that can be implemented in the first circulation sub 224, second circulation sub 234, third circulation sub 244, or a combination of these, of the example well tool 200 of FIG. 2. The example circulation sub 400 can allow a flow of the circulation fluid to a respective mill bit, or block the flow of the circulation fluid to a respective mill bit. The example circulation sub 400 includes a substantially cylindrical body 402 with a set of circulation ports 404 fluidly connecting an interior of the cylindrical body 402 to an exterior space around the circulation sub 400. The set of circulation ports 404 are disposed in the exterior wall of the cylindrical body 402, for example, to fluidly connect the interior to the exterior of the circulation sub 400.

Figure 4B:
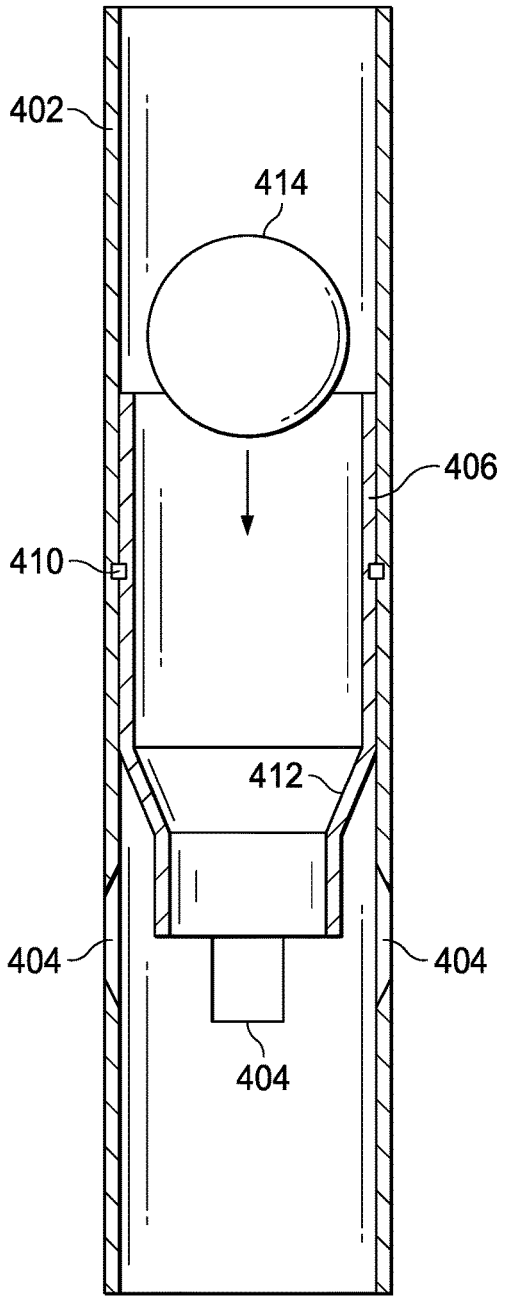
Figure 4C:
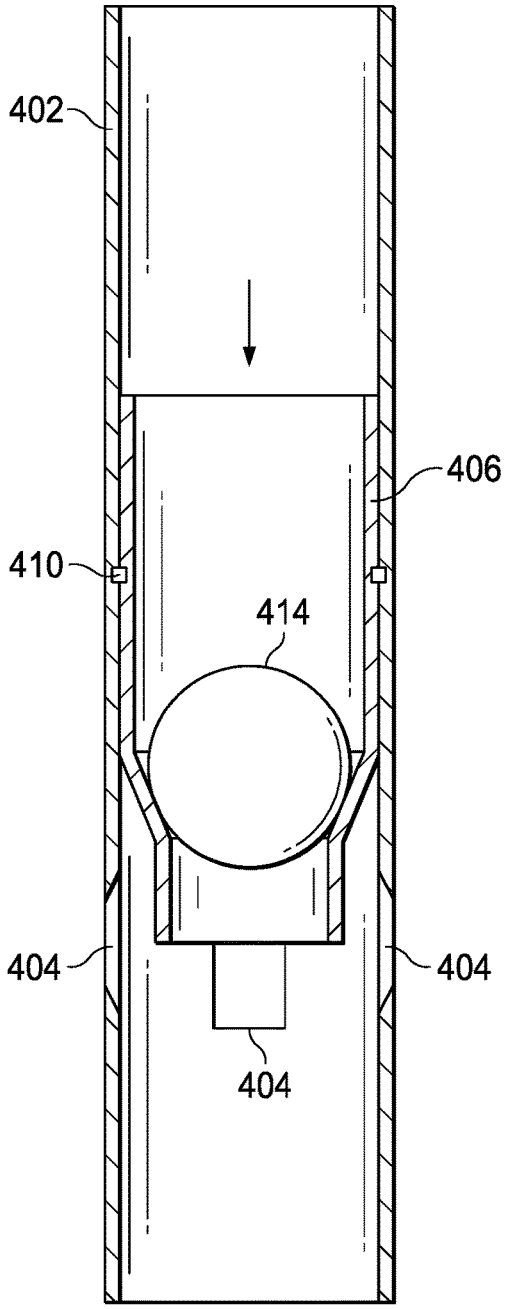
Figure 4D:
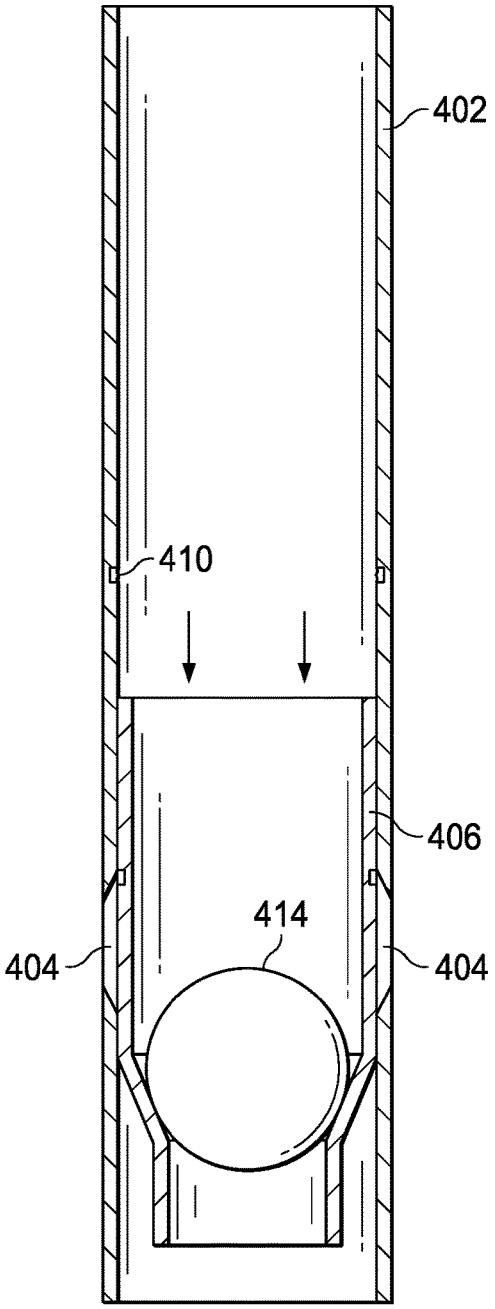

The example circulation sub 400 includes a sleeve valve 406 that is movable between a first position and a second position. In the first position of the sleeve valve 406, the set of circulation ports 404 are open to allow circulation fluid flow out of the circulation sub 400. In FIG. 4A, the sleeve valve 406 is in the first, open position, and the flowpath 408 of the circulation fluid flows through the set of circulation ports 404 and out of the circulation sub 400. FIGS. 4B-4D are partial cross-sectional schematic views of the example circulation sub 400 of FIG. 4A during a plugging operation that plugs the set of circulation ports 404 from fluid flow. The sleeve valve 406 is slidably connected to a radially inner surface of the cylindrical body 402, and the sleeve valve 406 is configured to longitudinally slide from the first, open position to the second, closed position to block and plug the circulation ports 404. In some instances, the sleeve valve 406 can be further actuated (for example, with a spring or actuator) to longitudinally slide back in the uphole direction to the first, open position, for example, to uncover and re-open the circulation ports 404. The sleeve valve 406 can be formed in the cylindrical body 402 of the circulation sub 400, and can be actuated by an actuation mechanism attached to the sleeve valve 406. The actuation mechanism can take many forms. In some examples, the actuation mechanism includes a mechanical-type actuator (for example, a linear actuator, rotary actuator, or hydraulic actuator), includes a ball seat configured to engage with a dropped ball, dart, or other plug from the surface to effect movement of the sleeve valve 406, or includes other actuator types. In the example circulation sub 400 of FIGS. 4A-4D, the sleeve valve 406 is actuated by a dropped ball.

In some examples, the sleeve valve 406 couples to the cylindrical body 402 of the circulation sub 400 and is held in the first, open position with a shear pin 410 or fuse. When a ball, plug, or other matching component is dropped into the circulation fluid pathway and reaches the seat of the sleeve valve 406, the interior of the circulation sub 400 can be pressurized (for example, from the surface) to shear the shear pin 410 or fuse, and slide the sleeve valve 406 into the second, closed position. In the second position of the sleeve valve 406, the sleeve valve physically plugs the circulation port(s) in the cylindrical body 402. With the circulation port(s) closed, the flow of circulation fluid cannot pass through the circulation sub 400, and instead, the circulation fluid can flow through an open circulation port of an adjacent circulation sub uphole of the example circulation sub 400.

In FIG. 4A, the sleeve valve 406 is in the first, open position. In FIG. 4D, the sleeve valve 406 is in the second, closed position to plug the circulation ports 404 from fluid flow. The sleeve valve 406 can take the form of a sliding sleeve supported in the cylindrical body 402 with the shear pin(s) 410 (or fuse, or other frangible support element that temporarily holds the sliding sleeve in place) that supports the sliding sleeve in the first, open position. The sleeve valve 406 includes a plug seat 412 (for example, a ball seat) that can receive and pressure seal with a dropped plug 414 (for example, a dropped ball, dart, or other plug) that is dropped from a surface of a well down through the drill pipe that is connected to the example circulation sub 400. In the example circulation sub 400 of FIGS. 4A-4D, the plug seat 412 is a ball seat and the dropped plug 414 is a dropped ball that is received on the ball seat. During the plugging operation, the plug 414 is dropped from an uphole location and into the drill pipe, and the plug seat 412 receives the dropped plug 414, as shown in FIG. 4B. When the ball 414 is dropped into the circulation fluid pathway and reaches the seat 412 of the sleeve valve 406, the interior of the circulation sub 400 can be pressurized (for example, from the surface) to a pressure threshold sufficient to shear the shear pin 410 that supports the sleeve valve 406 in the first position, as shown in FIG. 4C. After breaking the shear pin(s) 410, the sleeve valve 406 moves from the first position to the second position, as shown in FIG. 4D. In the second position of the sleeve valve 406, the sleeve valve 406 directly covers and plugs the set of circulation ports 404, thereby plugging the circulation ports 404 from fluid flow. With the circulation ports 404 closed, the flow of circulation fluid cannot pass through the circulation sub 400, and instead, the circulation fluid can flow through an open circulation port of an adjacent circulation sub uphole of the example circulation sub 400.

The example circulation sub 400 can be implemented in the first circulation sub 224, second circulation sub 234, third circulation sub 244, or a combination of these, of the example well tool 200 of FIG. 2. In some implementations, the first circulation sub 224 does not include a movable sleeve valve. For example, since the first circulation sub may be within the first mill bit 222 instead of part of a cylindrical body downhole of the first mill bit 222, the first circulation sub 224 can include a first cylindrical body that is interior to the first mill bit 222 and flush with, or uphole of, the first milling surface 226 of the first milling tool 220. The first cylindrical body is open at its downhole end to form a first circulation port, for example, to flow circulation fluid to the first milling surface 226 of the first milling tool 220. The first cylindrical body can also include a ball seat (or other type of plug seat) that can receive a dropped ball. When the ball seat of the first cylindrical body receives the dropped ball and the dropped ball seats in the ball seat, the first circulation port is effectively plugged from fluid flow through the first circulation port.

One or more or all of the circulation subs 224, 234, 244 of the example well tool 200 are operated with dropped balls to allow fluid flow through its respective circulation port(s) to a milling tool that is actively milling the tubular component 206, and to plug circulation fluid flow to a milling tool that is consumed and positioned within the bore 208 of the tubular component 206. Since the circulation subs 224, 234, 244 are oriented in series with each other along the drill pipe 210, a first ball seat of the first circulation sub 224 can have a first bore diameter, a second ball seat of the second circulation sub 234 can have a second bore diameter that is larger than the first bore diameter, and a third ball seat of the third circulation sub 244 can have a third bore diameter that is larger than the second bore diameter. In these instances, a first dropped ball, having a diameter greater than the first bore diameter and less than the second bore diameter, flows through the third ball seat and second ball seat and seats on the first ball seat to plug a first circulation port of the first circulation sub 224. A second dropped ball, having a diameter greater than the second bore diameter and less than the second bore diameter, flows through the third ball seat and seats on the second ball seat to plug a second circulation port of the second circulation sub 234. A third dropped ball, having a diameter greater than the third bore diameter and less than an internal diameter of the cylindrical body of the third circulation sub 244, seats on the third ball seat to plug a third circulation port of the third circulation sub 244. In some instances, during a milling operation of the example well tool 200, the first dropped ball is dropped after the first milling tool is partially or completely consumed, the second dropped ball is dropped after the second milling tool is partially or completely consumed, and the third dropped ball is dropped after the third milling tool is partially or completely consumed.

Figure 5A:
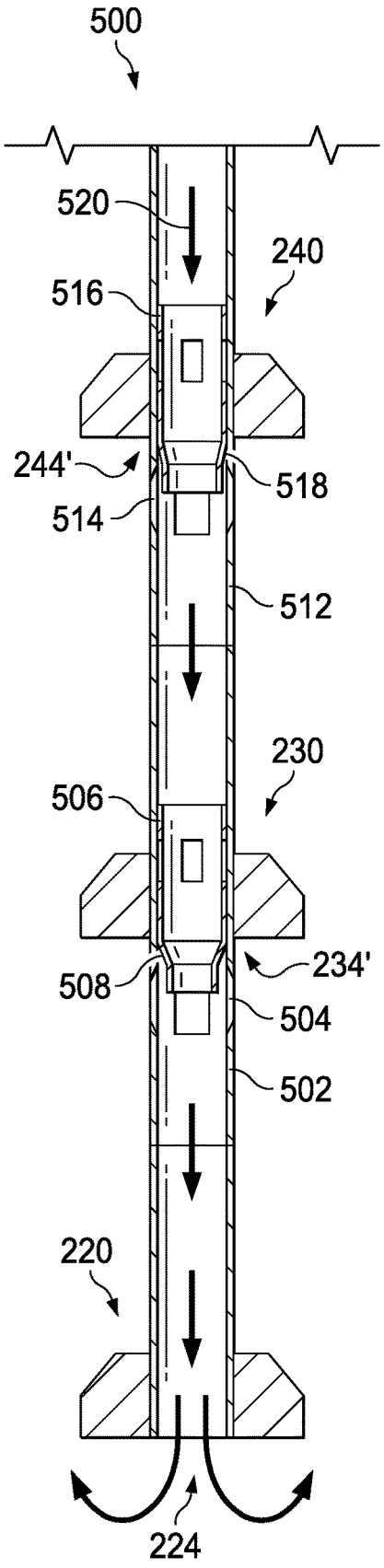
FIGS. 5A-5E are partial cross-sectional schematic views of an example well tool with circulation subs during a plugging operation.

In some implementations, the first circulation sub 224 of the first milling tool 220 includes a cylindrical opening at a downhole end of the first milling tool 200, and does not include a plug seat or sleeve valve. The second circulation sub 234 and third circulation sub 244 each include a circulation port or set of circulation ports that fluidly connect and direct a flow of the circulation fluid from the circulation fluid pathway 212 of the drill pipe 210 to the annulus of the wellbore 102 proximate to the respective mill bits 232, 242 during a milling operation of the respective mill bits 232, 242. However, the second circulation sub 234 and third circulation sub 244 include sliding sleeves that initially plug the circulation port(s), and are activated with a dropped ball (or other plug) to open the respective circulation port(s) and also to plug the central bore from fluid flow to a tool downhole of the respective circulation sub. For example, FIG. 5A is a partial cross-sectional schematic view of an example well tool 500 with a second circulation sub 234' of the second well tool 230 and a third circulation sub 244' of the third well tool 240. The sequential views of FIGS. 5A to 5E show the progression of an example circulation and plugging sequence performed by the example well tool 200 of FIG. 2. The example well tool 500 is the same as the example well tool 200 of FIG. 2, and can be implemented in the well tool 116 of the example well system 100 of FIG. 1, except that the second circulation sub 234' and the third circulation sub 244' include a sliding sleeve that plugs the circulation ports in a first position, and are actuated to move to a second position that open the circulation ports in a second position of the sliding sleeve.

The circulation ports are selectively controllable, for example, so that the milling tool that is milling a tubular component receives the flow of circulation fluid, while a worn out milling tool that is not actively milling the component does not receive a flow of the circulation fluid. In FIG. 5A, the third circulation sub 244' and second circulation sub 234' allow the flow of circulation fluid downhole to the first milling tool 220, and can be actuated to block the flow of the circulation fluid to the downhole mill bits. The example second circulation sub 234' includes a substantially cylindrical body 502 with a set of circulation ports 504 fluidly connecting an interior of the cylindrical body 502 to an exterior space around the circulation sub 234'. The set of circulation ports 504 are disposed in the exterior wall of the cylindrical body 502, for example, to fluidly connect the interior to the exterior of the second circulation sub 234'. The second circulation port 234' also includes a sleeve valve 506 with a plug seat 508, and the sleeve valve 506 is movable between a first position and a second position upon reception and activation of a corresponding plug (or ball 509). In the first position of the sleeve valve 506, the set of circulation ports are plugged from fluid flow because the sleeve valve 506 covers the circulation ports 504. The example third circulation sub 244' includes a similar construction as the second circulation sub 234', in that the third circulation sub 244' includes a substantially cylindrical body 512, a set of circulation ports 514, and a sleeve valve 516 with a plug seat 518, and the sleeve valve 516 is movable between a first position and a second position upon reception and activation of a corresponding plug (or ball 519).

In the schematic view of FIG. 5A, a fluid flowpath 520 of the circulation fluid flows through the first circulation sub 224 of the first milling tool 220. The sleeve valves 506 and 516 are slidably connected to the radially inner surface of the respective cylindrical body 502 and 512 closest to its respective milling tool and uphole of the first milling tool 220, and the sleeve valves 506 and 516 are configured to longitudinally slide from the first, open position to the second, closed position to open their respective circulation ports 504 and 514. The sleeve valves 506, 516 of the example well tool 500 of FIGS. 5A-5E are the same as the sleeve valve 406 of the example circulation sub 400 of FIGS. 4A-4D, except the sleeve valve 506, 516 operates to plug the circulation ports in the first position and opens the circulation ports to flow in the second position.

Figure 5B:
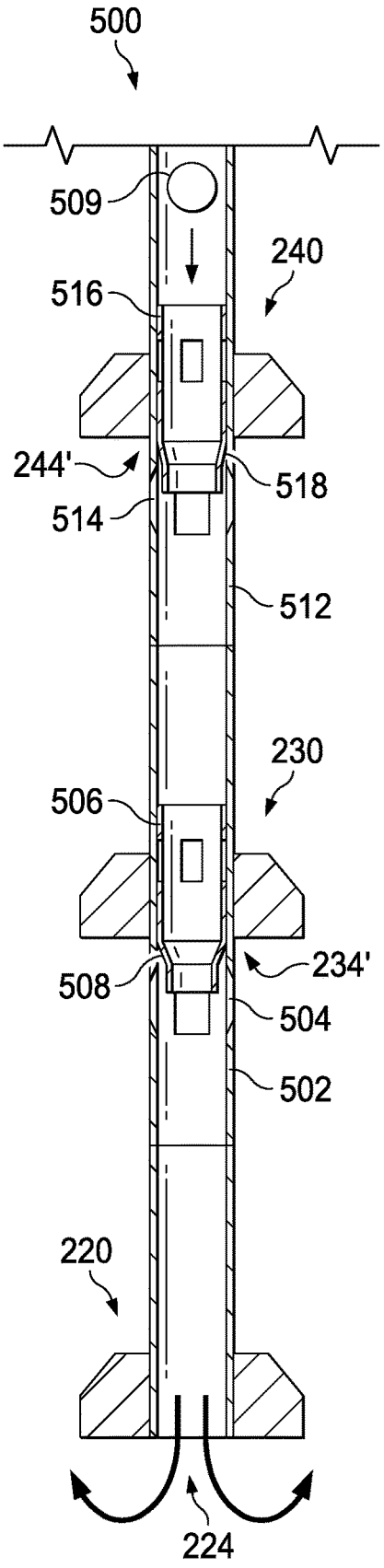
Figure 5C:
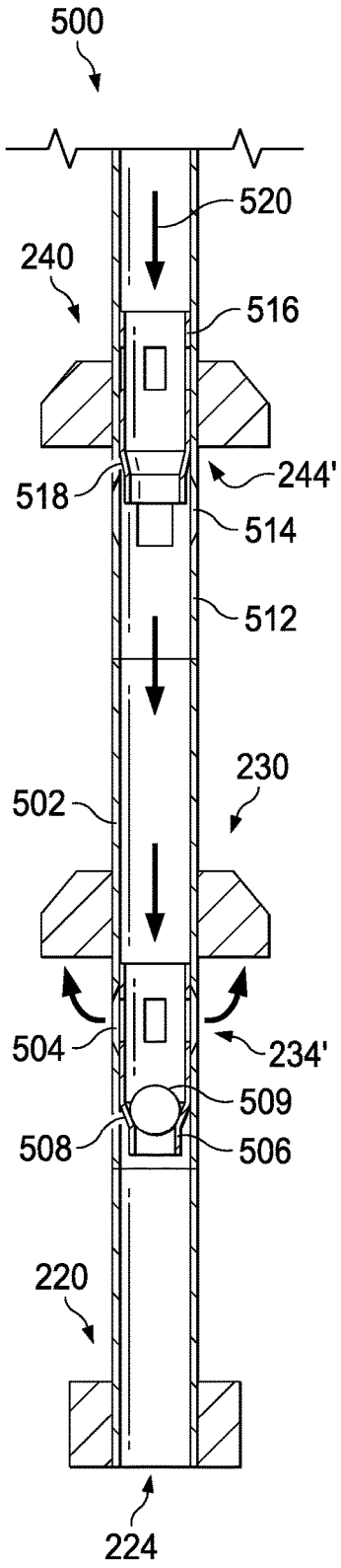

With respect to FIGS. 5B and 5C, the sleeve valve 506 of the second circulation sub 234' is held in the first, open position with a shear pin or fuse, and a ball 509, plug, or other matching component is dropped into the circulation fluid pathway and reaches the seat of the sleeve valve 506. The interior of the second circulation sub 234' can be pressurized (for example, from the surface) to shear the shear pin or fuse, and slide the sleeve valve 506 into the second position, as depicted in FIG. 5C. In the second position of the sleeve valve 506, the sleeve valve 506 opens the circulation port 504 in the cylindrical body 502 of the second circulation port 234'. With the circulation ports 504 open, the flow of circulation fluid passes through the second circulation sub 234', and into the annulus adjacent to the second milling surface of the second milling tool 230 while also plugging the central bore of the example well tool 500 from fluid flow to the milling tools downhole of the second milling tool 230.

Figure 5D:
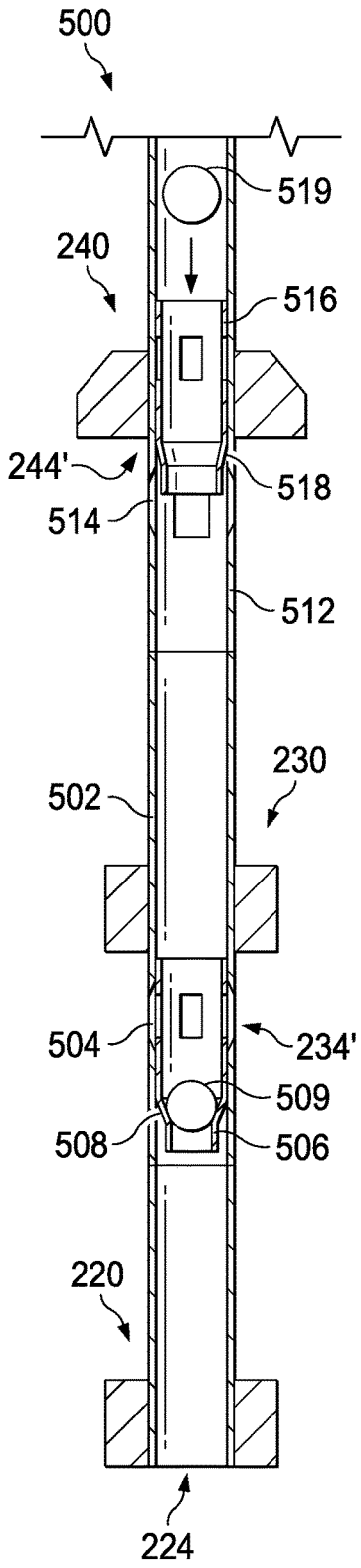
Figure 5E:
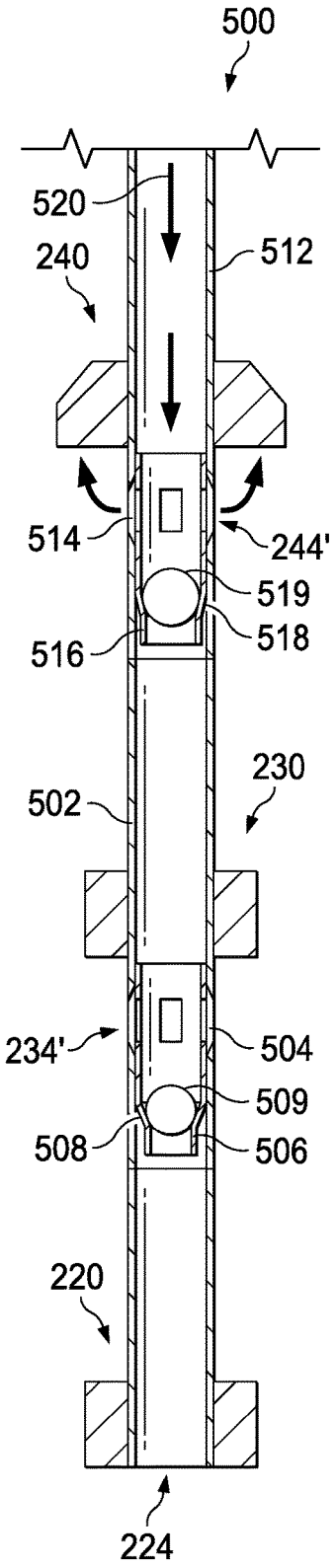

In a similar operation, with respect to FIGS. 5D and 5E, the sleeve valve 516 of the third circulation sub 244' is held in the first, open position with a shear pin or fuse, and a ball 519, plug, or other matching component is dropped into the circulation fluid pathway and reaches the seat of the sleeve valve 516. The interior of the third circulation sub 244' can be pressurized (for example, from the surface) to shear the shear pin or fuse, and slide the sleeve valve 516 into the second position, as depicted in FIG. 5E. In the second position of the sleeve valve 516, the sleeve valve 516 opens the circulation port 514 in the cylindrical body 512 of the third circulation port 244'. With the circulation ports 514 open, the flow of circulation fluid passes through the second circulation sub 244', and into the annulus adjacent to the third milling surface of the third milling tool 240 while also plugging the central bore of the example well tool 500 from fluid flow to the milling tools downhole of the third milling tool 240.

The example second circulation sub 234' is the same as the example circulation sub 400 of FIGS. 4A-4D, except that the example second circulation sub 234' acts to initially plug the circulation ports 504 in the first position, and is activated to open the circulation ports 504 to fluid flow upon reception of the dropped ball 509 and activation of the sliding sleeve 506. The example third circulation sub 244' is the same as the example circulation sub 400 of FIGS. 4A-4D, except that the example third circulation sub 244' acts to initially plug the circulation ports 514 in the first position, and is activated to open the circulation ports 514 to fluid flow upon reception of the dropped ball 519 and activation of the sliding sleeve 516.

The second circulation sub 234' and third circulation sub 244' of the example well tool 500 are operated with dropped balls to allow fluid flow through its respective circulation port(s) to a milling tool that is actively milling a tubular component, and to plug circulation fluid flow to a milling tool that is consumed and positioned within the bore of the tubular component. Since the circulation subs 234' and 244' are oriented in series with each other along the drill pipe 210, the ball seat of the second circulation sub 234' can have a bore diameter that is smaller than the ball seat of the third circulation sub 244'. In these instances, the dropped ball 509 has a diameter greater than the bore diameter of the sleeve valve 516 of the third circulation sub 244' and less than the bore diameter of the sleeve valve 506 of the second circulation sub 234'. Other dropped ball 519 has a diameter greater than the bore diameter of the sleeve valve 516 of the third circulation sub 244', and seats on the sleeve valve 516 to plug the sleeve valve 516 and open the circulation ports 514 of the third circulation sub 244'.

FIGS. 6A-6F are schematic partial cross-sectional side views of an example well tool 600 disposed in a casing 602 over a tubular 604. The sequential views of FIGS. 6A to 6F show the progression of an example milling sequence performed by the example well tool 600. The example well tool 600 is the same as the example well tool 200 of FIG. 2, and can be implemented in the well tool 116 of the example well system 100 of FIG. 1. The example well tool 600 includes the first milling tool 220, the second milling tool 230, and the third milling tool 240, which are operated in sequence to mill out a portion of or the entirety of the tubular 604.

Figure 6A:
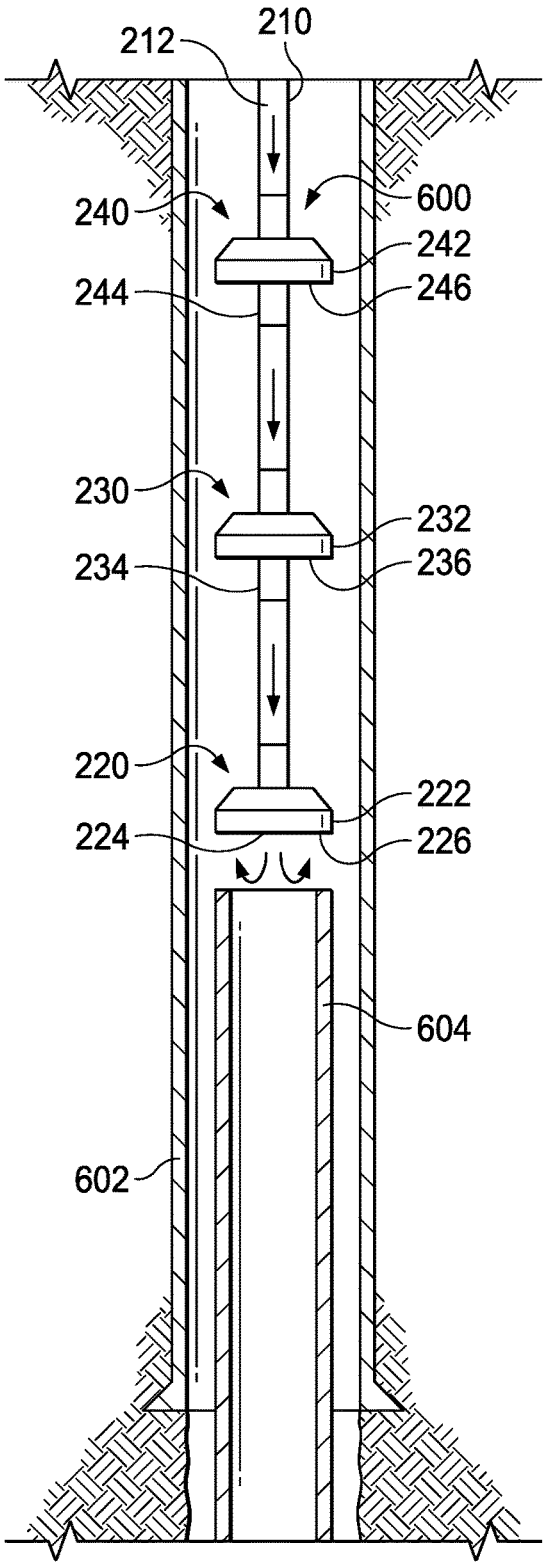
FIGS. 6A-6F are schematic, partial cross-sectional side views an example well tool sequentially showing a progression of an example milling sequence performed by the example well tool.
Figure 6B:
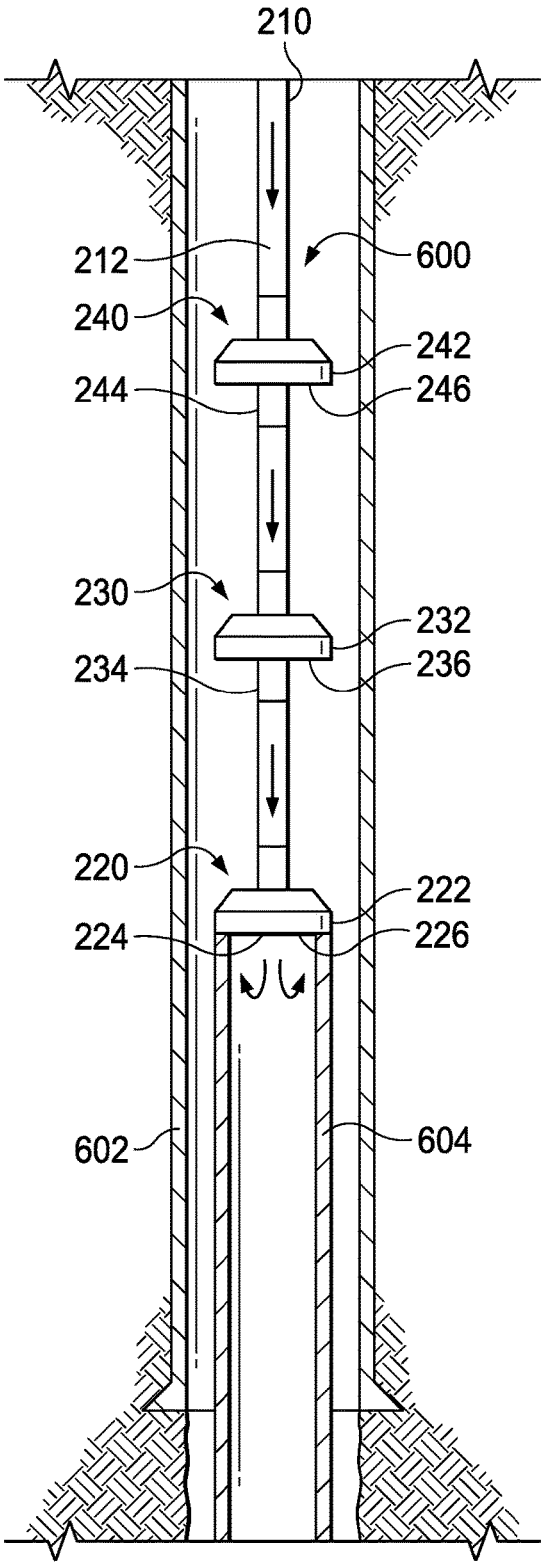
Figure 6C:
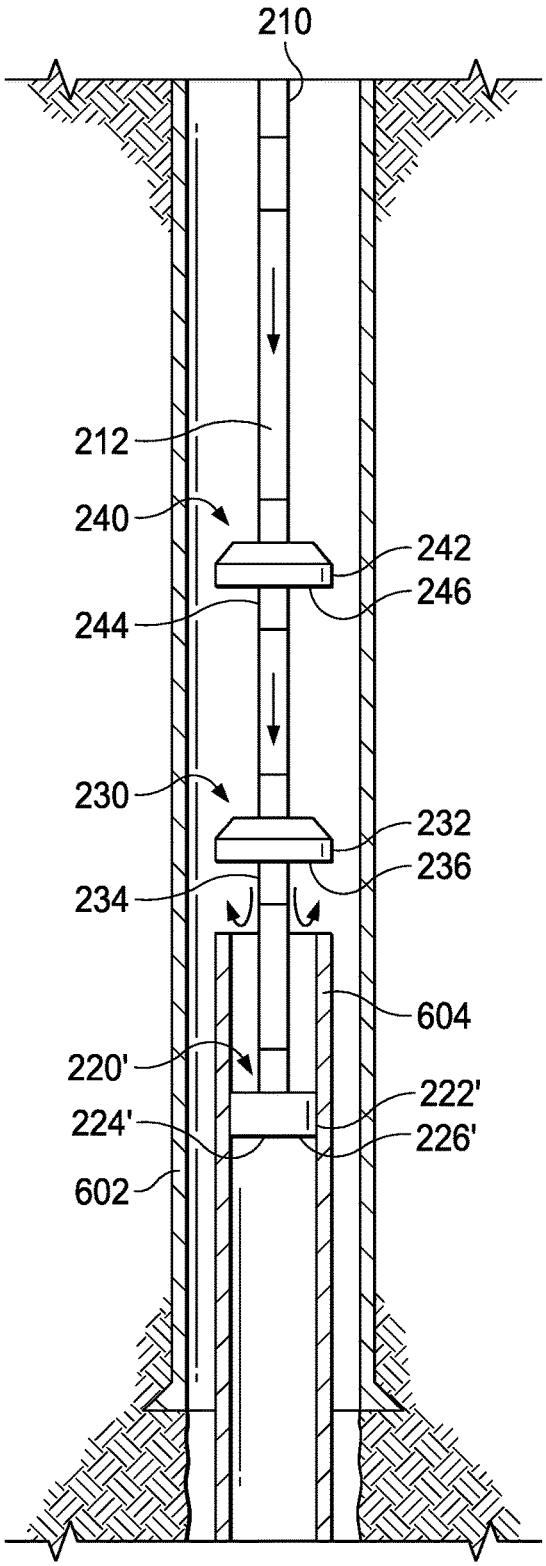
Figure 6D:
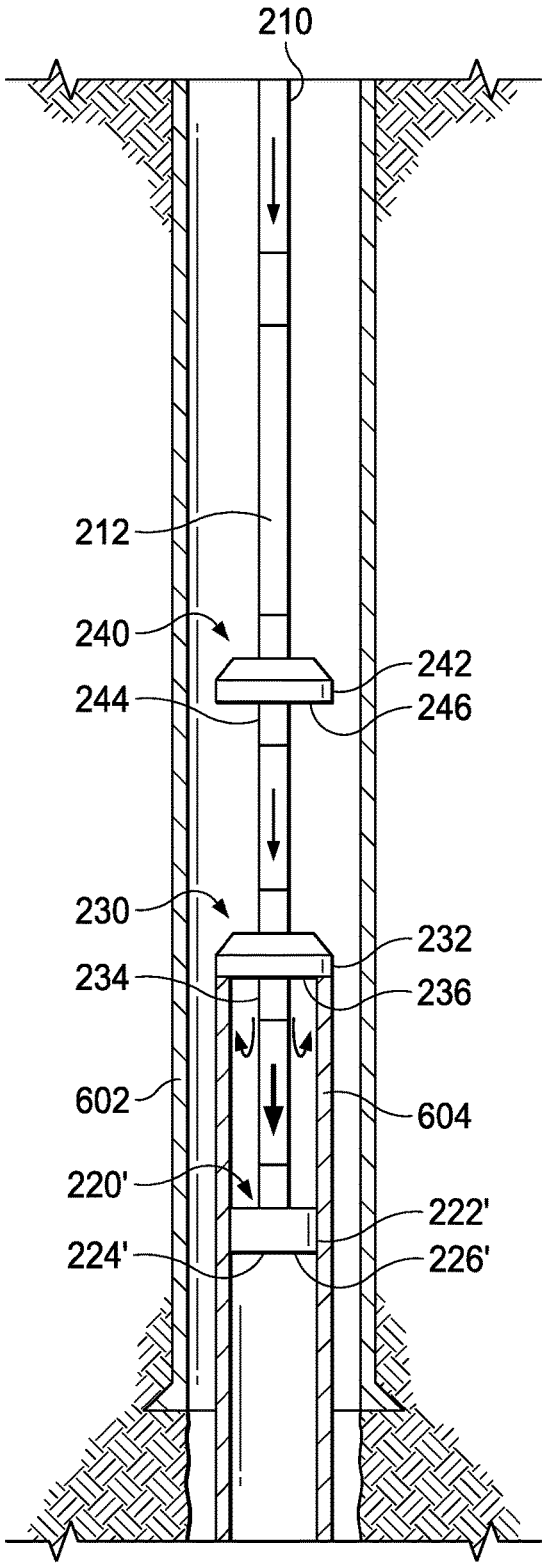
Figure 6E:
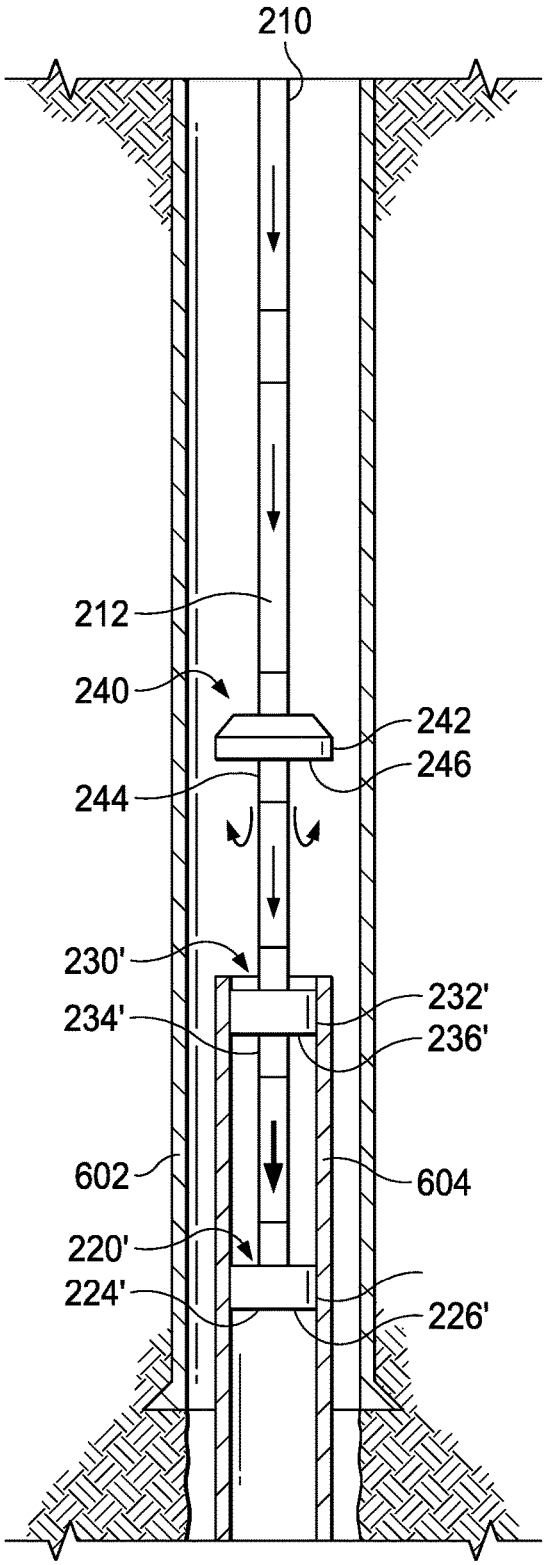
Figure 6F:
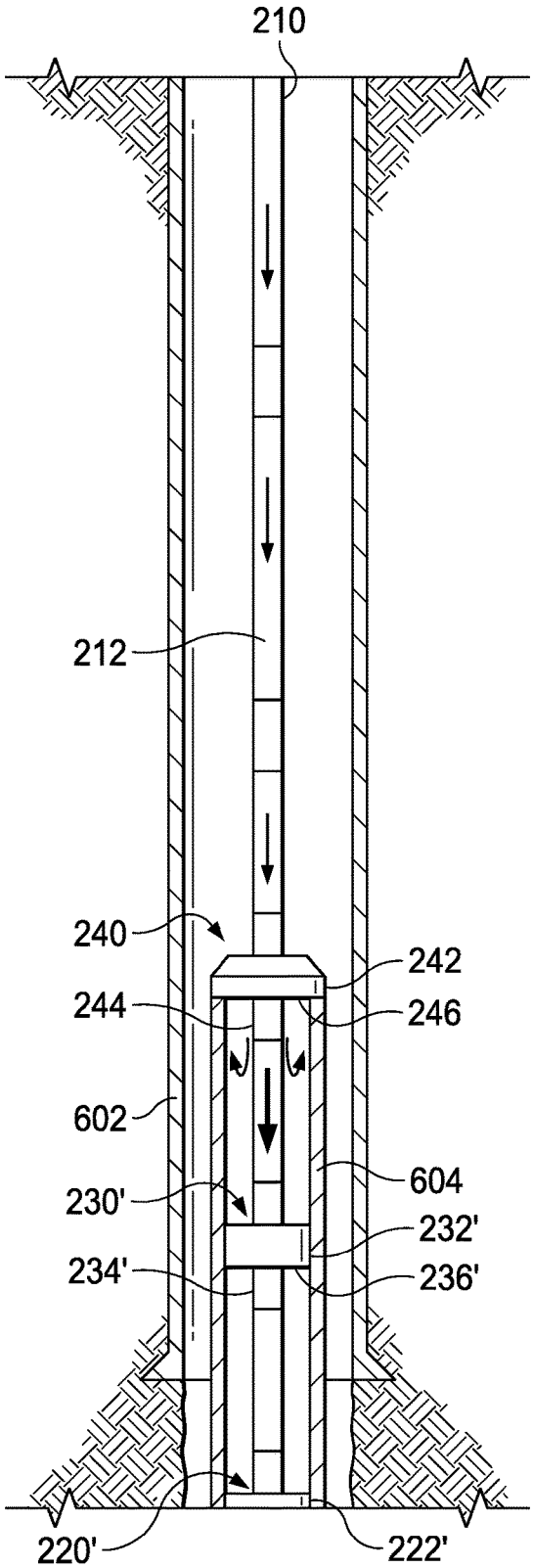

Referring to FIG. 6A, the example well tool 600 is disposed within the casing 602 just uphole of the tubular 604. Circulation fluid flows through the circulation fluid pathway 212 of the drill pipe 210 and through the first circulation port of the first circulation sub 224 to cool the first mill bit 222 as it mills the tubular 604, as shown in the view of FIG. 6B. After the material of the first mill bit 222 is worn down through the thickness of the first mill bit 222, the diameter of the first mill bit 222 is reduced and the first mill bit 222 is lowered by the drill pipe 210 into the tubular 604. The view of FIG. 6C shows the first milling tool 220 as consumed and residing within the tubular 604, and the circulation fluid now flows through the second circulation port of the second circulation sub 234 (or 234') after the first circulation sub 224 is plugged with a first dropped ball. The circulation fluid flows through the second circulation port of the second circulation sub 234 to cool the second mill bit 232 as it mills the tubular 604, as shown in the view of FIG. 6D. After the material of the second mill bit 232 is worn down through the thickness of the second mill bit 232, the diameter of the second mill bit 232 is reduced and the second mill bit 232 is also lowered by the drill pipe 210 into the tubular 604. The view of FIG. 6E shows the first milling tool 220 and the second milling tool 230 as consumed and residing within the tubular 604. After the second circulation sub 234 is plugged with a second dropped ball, the circulation fluid flows through the third circulation port of the third circulation sub 244 to cool the third mill bit 242 as the third milling tool 240 mills the tubular 604.

Figure 7:
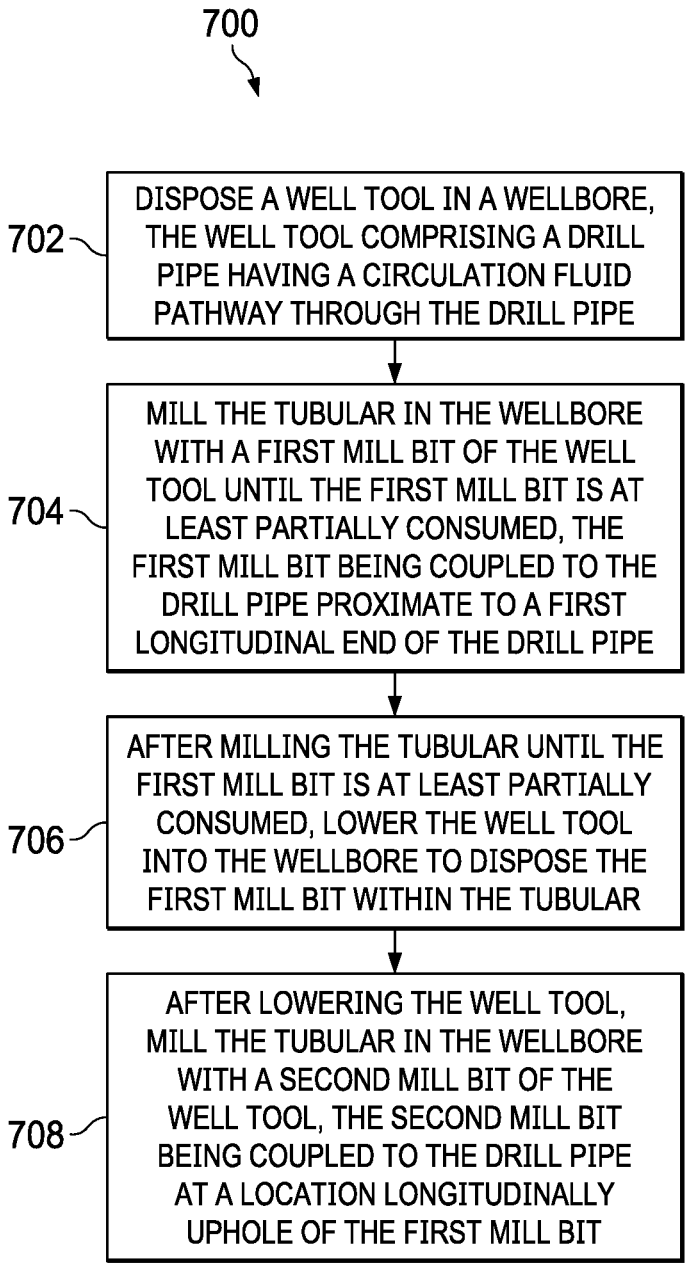
FIG. 7 is a flowchart describing an example method for milling a tubular in a wellbore.

FIG. 7 is a flowchart describing an example method 700 for milling a tubular in a wellbore, for example performed by the example well tool 200 of FIG. 2 or the example well tool 600 of FIGS. 6A-6F. At 702, a well tool is disposed in a wellbore, and the well tool includes a drill pipe having a circulation fluid pathway through the drill pipe. At 704, a first mill bit of the well tool mills the tubular in the wellbore until the first mill bit is at least partially consumed. In some instances, the first mill bit is coupled to the drill pipe at a location that is proximate to a first longitudinal end of the drill pipe. At 706, after milling the tubular until the first mill bit is at least partially consumed, the well tool is lowered into the wellbore to dispose the first mill bit within the tubular. At 708, after the well tool is lowered, a second mill bit of the well tool mills the tubular in the wellbore. The second mill bit is coupled to the drill pipe at a location longitudinally uphole of the first mill bit. In some implementations, a circulation fluid flows to the first mill bit through a first circulation port in a first circulation sub at the first mill bit, where the first circulation port fluidly connects the circulation fluid pathway to an annulus of the wellbore. After milling the tubular with the first mill bit, the first circulation port can be plugged with a first dropped plug. Plugging the first circulation port can include activating a movable sleeve valve in the first circulation sub to plug the first circulation port. While milling the tubular with the second mill bit, the circulation fluid flows to the second mill bit through a second circulation port in a second circulation sub at the second mill bit, and the second circulation port is located downhole of the second mill bit to flow the circulation fluid from within the second circulation sub to the annulus of the wellbore proximate to the second mill bit. After the second mill bit is consumed, the well tool can be lowered into the wellbore to dispose the second mill bit within the tubular, the second circulation port can be plugged with a second dropped plug, and a third mill bit can mill the tubular. The third mill bit is coupled to the drill pipe at a location longitudinally uphole from the second mill bit.

A number of implementations have been described. Nevertheless, it will be understood that various modifications may be made without departing from the spirit and scope of the disclosure.

What is claimed is:

1. A well tool for milling a tubular, the well tool comprising:

a well tubing configured to be disposed in a wellbore, the well tubing comprising a circulation fluid pathway through an interior of the well tubing;

a first milling tool coupled to the well tubing at a first longitudinal end of the well tubing, the first milling tool comprising a first mill bit and a first circulation sub fluidly connected to the circulation fluid pathway, the first milling tool configured to mill a first portion of the tubular;

a second milling tool coupled to the well tubing at a location longitudinally uphole from the first milling tool, the second milling tool comprising a second mill bit and a second circulation sub fluidly connected to the circulation fluid pathway, the second milling tool configured to mill a second portion of the tubular, wherein, when the first mill bit is configured to mill the first portion of the tubular, the second mill bit is configured to be outside of the tubular; and a third milling tool coupled to the well tubing at a location longitudinally uphole from the second milling tool, the third milling tool comprising a third mill bit and a third circulation sub fluidly connected to the circulation fluid pathway, the third milling tool configured to mill a third portion of the tubular.

2. The well tool of claim 1, wherein the first mill bit comprises a first milling surface having a first outer diameter, the second mill bit comprises a second milling surface with a second outer diameter, and the third mill bit comprises a third milling surface with a third outer diameter.

3. The well tool of claim 2, wherein the first outer diameter, second outer diameter, and third outer diameter are the same.

4. The well tool of claim 2, wherein at least one of the first mill bit, the second mill bit, or the third mill bit comprises a pilot mill bit.

5. The well tool of claim 4, wherein the first mill bit comprises a flat-bottom milling surface, and at least one of the second mill bit or the third mill bit comprises the pilot mill bit.

6. The well tool of claim 1, wherein the first circulation sub comprises a first circulation port configured to fluidly couple the circulation fluid pathway to an annulus of the wellbore downhole of the first mill bit.

7. The well tool of claim 6, wherein the second circulation sub comprises a second circulation port through an exterior wall of the second circulation sub downhole of the second mill bit, the second circulation port configured to fluidly couple the circulation fluid pathway to the annulus downhole of the second mill bit, and the third circulation sub comprises a third circulation port through an exterior wall of the third circulation sub downhole of the third mill bit, the third circulation port configured to fluidly couple the circulation fluid pathway to the annulus downhole of the third mill bit.

8. The well tool of claim 7, wherein the first circulation sub comprises a first cylindrical body and a first plug seat configured to receive a first dropped plug and plug the first circulation port.

9. The well tool of claim 7, wherein the second circulation sub comprises a first cylindrical body and a first sleeve valve within the first cylindrical body, the first sleeve valve comprising a first plug seat configured to receive a first dropped plug and selectively open the second circulation port.

10. The well tool of claim 9, wherein the third circulation sub comprises a second cylindrical body and a second sleeve valve within the second cylindrical body, the second sleeve valve comprising a second plug seat configured to receive a second dropped plug and selectively open the third circulation port.

11. The well tool of claim 10, wherein a first bore diameter of the first plug seat is less than a second bore diameter of the second plug seat.

12. The well tool of claim 1, wherein, when the second mill bit is configured to mill the second portion of the tubular, the first mill bit is configured to be disposed within the tubular and the third mill bit is configured to be outside of the tubular.

13. A method for milling a tubular in a wellbore, the method comprising:

disposing a well tool in a wellbore, the well tool comprising a well tubing having a circulation fluid pathway through the well tubing;

milling the tubular in the wellbore with a first mill bit of the well tool until the first mill bit is at least partially consumed, the first mill bit being coupled to the well tubing proximate to a first longitudinal end of the well tubing, the well tool comprising a first circulation sub at the first mill bit;

after milling the tubular until the first mill bit is at least partially consumed, lowering the well tool into the wellbore to dispose the first mill bit within the tubular; and after lowering the well tool, milling the tubular in the wellbore with a second mill bit of the well tool, the second mill bit being coupled to the well tubing at a location longitudinally uphole of the first mill bit, the well tool comprising a second circulation sub at the second mill bit, wherein, when the first mill bit mills the tubular in the wellbore, the second mill bit is outside of the tubular.

14. The method of claim 13, wherein milling the tubular with the first mill bit comprises flowing a circulation fluid to the first mill bit through a first circulation port in the first circulation sub at the first mill bit, the first circulation port fluidly connecting the circulation fluid pathway to an annulus of the wellbore; and the method further comprising, after milling the tubular with the first mill bit until the first mill bit is at least partially consumed, plugging flow to the first circulation port with a first dropped plug.

15. The method of claim 14, wherein the first circulation sub comprises a first cylindrical body and a first sleeve valve comprising a first plug seat, and wherein plugging flow to the first circulation port with the first dropped plug comprises engaging the first plug seat with the first dropped plug and sliding the first sleeve valve from a first, open position to a second, closed position of the first sleeve valve to plug the first circulation port.

16. The method of claim 14, wherein milling the tubular with the second mill bit comprises flowing the circulation fluid to the second mill bit through a second circulation port in the second circulation sub at the second mill bit, the second circulation port located downhole of the second mill bit and configured to flow the circulation fluid from within the second circulation sub to the annulus of the wellbore proximate to the second mill bit.

17. The method of claim 16, wherein the second circulation sub comprises a sleeve valve having a plug seat, and plugging flow to the first circulation port with a first dropped plug comprises:

receiving the first dropped plug in the plug seat of the sleeve valve of the second circulation sub, and moving the sleeve valve from a first position to a second position to open the second circulation port to the flow of circulation fluid.

18. The method of claim 16, wherein milling the tubular with the second mill bit comprises milling the tubular until the second mill bit is at least partially consumed, and the method further comprising:

after milling the tubular until the second mill bit is at least partially consumed, lowering the well tool into the wellbore to dispose the second mill bit within the tubular; and after lowering the well tool, milling the tubular in the wellbore with a third mill bit of the well tool, the third mill bit being coupled to the well tubing at a location longitudinally uphole from the second mill bit.

19. The method of claim 18, the method further comprising, after milling the tubular with the second mill bit until the second mill bit is at least partially consumed, plugging the second circulation port with a second dropped plug, and wherein milling the tubular with the third mill bit comprises flowing the circulation fluid to the third mill bit through a third circulation port in a third circulation sub at the third mill bit, the third circulation port located downhole of the third mill bit and configured to flow the circulation fluid from within the third circulation sub to the annulus of the wellbore proximate to the third mill bit.

20. The method of claim 19, wherein the third circulation sub comprises a second sleeve valve having a second plug seat, and plugging the second circulation port with the second dropped plug comprises:

receiving the second dropped plug in the second plug seat of the second sleeve valve of the third circulation sub, and moving the second sleeve valve from a first position to a second position to open the third circulation port to the flow of circulation fluid.

21. The method of claim 18, wherein, when the second mill bit mills the tubular in the wellbore, the first mill bit has been consumed, and the third mill bit is outside of the tubular.

22. A well tool for milling a tubular, the well tool comprising:

a drill pipe configured to be disposed in a wellbore, the drill pipe comprising a circulation fluid pathway through an interior of the drill pipe;

a first milling tool coupled to the drill pipe at a first longitudinal end of the drill pipe, the first milling tool comprising a first mill bit and a first circulation sub fluidly connected to the circulation fluid pathway, the first milling tool configured to mill a first portion of a tubular; and a second milling tool coupled to the drill pipe at a location longitudinally uphole from the first milling tool, the second milling tool comprising a second mill bit and a second circulation sub fluidly connected to the circulation fluid pathway, wherein the second milling tool is configured to mill a second portion of the tubular, and when the first mill bit is configured to mill the first portion of the tubular, the second mill bit is configured to be outside of the tubular.

23. The well tool of claim 22, wherein the first mill bit comprises a first milling surface having a first outer diameter, the second mill bit comprises a second milling surface with a second outer diameter, and the first outer diameter is the same as the second outer diameter.

24. The well tool of claim 22, wherein the first circulation sub comprises a first circulation port configured to fluidly couple the circulation fluid pathway to an annulus of the wellbore downhole of the first mill bit; and wherein the second circulation sub comprises a second circulation port through an exterior wall of the second circulation sub downhole of the second mill bit, the second circulation port configured to fluidly couple the circulation fluid pathway to the annulus downhole of the second mill bit.

25. The well tool of claim 24, wherein the second circulation sub comprises a cylindrical body and a sleeve valve within the cylindrical body, the sleeve valve comprising a plug seat configured to receive a dropped plug and selectively open the second circulation port.

* * * * *